US006044814A

United States Patent [19]

Fuwa

[11] Patent Number: 6,044,814

[45] Date of Patent: Apr. 4, 2000

[54] ELECTROMAGNETICALLY DRIVEN VALVE CONTROL APPARATUS AND METHOD FOR AN INTERNAL COMBUSTION ENGINE

[75] Inventor: Toshio Fuwa, Nagoya, Japan

[73] Assignee: Toyota Jidosha Kabushiki Kaisha, Aichi-Ken, Japan

[21] Appl. No.: 09/211,917

[22] Filed: Dec. 15, 1998

[30] Foreign Application Priority Data

Jan. 19, 1998 [JP] Japan ..... 10-007622

[51] Int. Cl.[7] ..... F01L 9/04

[52] U.S. Cl. ..... 123/90.11; 251/129.01; 335/266

[58] Field of Search ..... 123/90.11, 90.15; 251/129.01, 129.1, 129.16; 335/266, 268

[56] References Cited

U.S. PATENT DOCUMENTS

| | | | |
|---|---|---|---|
| 4,794,891 | 1/1989 | Knobloch | 123/90.11 |
| 5,636,601 | 6/1997 | Moriya et al. | 123/90.11 |
| 5,671,705 | 9/1997 | Matsumoto et al. | 123/90.11 |
| 5,748,433 | 5/1998 | Schrey et al. | 361/210 |
| 5,775,276 | 7/1998 | Yanai et al. | 123/90.11 |
| 5,782,211 | 7/1998 | Kamimaru | 123/90.11 |
| 5,889,405 | 3/1999 | Yanai et al. | 324/522 |

FOREIGN PATENT DOCUMENTS

| | | |
|---|---|---|
| 6-129218 | 5/1994 | Japan . |
| 9-195736 | 7/1997 | Japan . |

*Primary Examiner*—Weilun Lo
*Attorney, Agent, or Firm*—Kenyon & Kenyon

[57] ABSTRACT

A control apparatus for a valve of an internal combustion engine electrically opens and closes an intake or exhaust valve of the internal combustion engine with reduced power consumption while securing stable operating characteristics. The electromagnetically driven valve is opened and closed by combining an electromagnetic force produced by upper and lower electromagnets and an elastic force produced by upper and lower springs. At a timing at which one of the upper and lower electromagnets is to attract the valve, a predetermined attracting current is supplied to the respective one of the upper and lower electromagnets, and it is detected whether there is a step out of the valve. If a step out is detected, the attracting current applied to the respective one of the upper and lower electromagnets in the next cycle is increased. If the step out is not detected, the attracting current used in the next cycle is decreased.

12 Claims, 23 Drawing Sheets

ELECTROMAGNETICALLY DRIVEN VALVE CONTROL APPARATUS AND METHOD FOR AN INTERNAL COMBUSTION ENGINE

INCORPORATION BY REFERENCE

The disclosure of Japanese Patent Application No. HEI 10-7622 filed on Jan. 19, 1998 including the specification, drawings and abstract is incorporated herein by reference in its entirety.

BACKGROUND OF THE INVENTION

1. Field of the Invention

The present invention relates to an electromagnetically driven valve control apparatus for an internal combustion engine and, more particularly, to an electromagnetically driven valve control apparatus and an electromagnetically driven valve control method that electrically open and close an intake valve or an exhaust valve of an internal combustion engine.

2. Description of the Related Art

An electromagnetically driven valve that functions as an intake or exhaust valve of an internal combustion engine is disclosed, for example, in Japanese Patent Application Laid-Open No. HEI 9-195736. The electromagnetically driven valve has a spring that urges the valve to a neutral position, an upper electromagnet that draws the valve to a fully open position, and a lower electromagnet that draws the valve to a completely closed position. Thus, the electromagnetically driven valve may be opened and closed by supplying appropriate currents alternately to the upper and lower electromagnets.

The electromagnetic force needed to open and close an electromagnetically driven valve of an internal combustion engine varies depending on the operating condition of the internal combustion engine, the temperature of the electromagnetically driven valve, etc. In order to ensure reliable operation of an electromagnetically driven valve while using a minimum amount of power, it is desirable that the exciting current supplied to the electromagnets be controlled to a minimum required amount. In the aforementioned conventional electromagnetically driven valve, the waveform of the exciting current supplied to the electromagnets is changed in accordance with the operating conditions of the internal combustion engine, and the like.

However, the effect of external disturbances on the valve may not be constant even when the operating condition of the internal combustion engine and other conditions remain unchanged. Therefore, it is difficult to precisely determine a minimum electromagnetic force needed to operate the valve solely on the basis of the operating conditions of the internal combustion engine and the like. Consequently, in a valve apparatus as described above, it is desirable to consider variations in external disturbances in setting a waveform of the exciting current, more specifically, it is desirable to consider the greatest external disturbance that impedes operation of the valve.

SUMMARY OF THE INVENTION

Accordingly, it is an object of the present invention to provide an electromagnetically driven valve control apparatus and an electromagnetically driven valve control method for an internal combustion engine that are able to reduce electric power consumption.

According to a first aspect of the invention, there is provided an electromagnetically driven valve control apparatus for an internal combustion engine for opening and closing a valve by combining an electromagnetic force produced by an electromagnet and an elastic force produced by an elastic member. The control apparatus includes an attracting current supply device for supplying an attracting current to the electromagnet when it is desired to attract the valve to the electromagnet, a step-put detection device for detecting a step out of the valve from a predetermined opening and closing operation, an attracting current increase device for, when the step out is detected, increasing the attracting current used in the next cycle, and an attracting current decrease device for, when the step out is not detected, decreasing the attracting current used in the next cycle.

In the control apparatus of the invention, the attracting current is supplied to the electromagnet when the electromagnet needs to attract the valve. If the attraction of the valve to the electromagnet is not performed normally, that is, if the step out of the valve occurs, the attracting current used in the next cycle is increased. Conversely, if the attraction of the valve to the electromagnet is properly performed, the attracting current used in the next cycle is decreased. Through this operation, the attracting current is always maintained at a minimum sufficient value for properly opening and closing the valve.

The electromagnetically driven valve control apparatus of the invention may further include a return current supply device for, after the step out is detected, supplying to the electromagnet a return current that is greater than the attracting current.

In this electromagnetically driven valve control apparatus, after the step out is detected, the return current greater than the attracting current is supplied to the electromagnet. When the return current is supplied to the electromagnet, a great electromagnetic force is produced between the electromagnet and the valve so that the valve may recover from the step out and become properly attracted to the electromagnet. Therefore, through the operation described above, it becomes possible to quickly return the valve to a normal state after the valve has stepped out.

The electromagnetically driven valve control apparatus of the invention may further include a forward switch circuit that applies a voltage to the electromagnetic in a forward direction, a reverse switch circuit that applies a voltage to the electromagnet in a reverse direction, and a switch circuit control device for selectively operating the forward switch circuit and the reverse switch circuit so that an exciting current through the electromagnet becomes substantially equal to a predetermined instruction current. In this control apparatus, the step-out detection device detects a step out when a voltage between two terminals of the electromagnet is smaller than a predetermined threshold at which timing the exciting current needs to be maintained or increased.

The control apparatus described above performs an operation to increase the exciting current at timing at which the valve needs to be attracted to the electromagnet. The control apparatus performs an operation to maintain the exciting current at timing at which the valve needs to be held adjacent to the electromagnet. If the valve operates properly without a step out, the exciting current is controlled as described above, so that the valve approaches the electromagnet and then is held adjacent to the electromagnet.

The electromagnet becomes more likely to produce great magnetic flux $\Phi$ as the valve approaches the electromagnet. Therefore, if the valve is properly displaced toward the electromagnet, the magnetic flux $\Phi$ undergoes a change $d\Phi/dt$ (>0) in the increasing direction. In this case, in order to cancel out a reverse electromotive force $-d\Phi/dt$ (<0) and cause the exciting current I to continuously flow, the forward switch circuit is turned on. Therefore, a positive voltage $V=R\cdot I+d\Phi/dt$ (where R is the electrical resistance of the electromagnet) occurs between the two terminals of the electromagnet. If the valve is properly held adjacent to the electromagnet, the magnetic flux $\Phi$ does not change. In order to continue the exciting current I, the forward switch circuit is turned on. Therefore, a positive voltage $V=R\cdot I$ occurs between the two terminals of the electromagnet.

When the valve steps out at a time at which the valve needs to approach the electromagnet or at a time at which the valve needs to be held adjacent to the electromagnet, the distance between the valve and the electromagnet increases. When the distance between the valve and the electromagnet increases, the magnetic flux $\Phi$ produced by the electromagnet decreases. At this moment, the electromagnet produces a reveres electromotive force $-d\Phi/dt$ (>0) in such a direction as to increase the exciting current, that is, to hinder the decrease of the magnetic flux $\Phi$.

In this case, the switch control device turns on one of the forward switch circuit and the reverse switch circuit so that a voltage $V=R\cdot I-(-d\Phi/dt)$, canceling out the reverse electromotive force and continuing the flowing of the current I, occurs between the two terminals of the electromagnet. That is, according to the invention, a voltage V equal to or greater than $R\cdot I$ occurs between the two terminals of the electromagnet when the valve is operating properly. Conversely, when the valve steps out, a voltage V less than $R\cdot I$ occurs between the two terminals of the electromagnet. The step-out detection device determines which of the aforementioned situations is occurring, by comparing the voltage between the two terminals of the electromagnet with the threshold. Based on the determination, the step-out detection device determines whether the valve has stepped out. Through this technology, it becomes possible to precisely detect the step out of the valve.

The electromagnetically driven valve control apparatus of the invention may further include a forward switch circuit that applies a voltage to the electromagnet in a forward direction, a reverse switch circuit that applies a voltage to the electromagnet in a reverse direction, and a switch circuit control device for selectively operating the forward switch circuit and the reverse switch circuit so that an exciting current through the electromagnet becomes substantially equal to a predetermined instruction current. In this control apparatus, the step-out detection device detects the step out when the reverse switch circuit is operated at a time at which the exciting current needs to be maintained or increased.

In the control apparatus described above, if the valve operates normally during the increase of the exciting current and during the subsequent maintenance of the exciting current, the forward switch circuit is operated so that a voltage V equal to or higher than $R\cdot I$ occurs between the two terminals of the electromagnet. Conversely, if the valve steps out while the exciting current is increased or maintained, the electromagnet produces a reverse electromotive force $-d\Phi/dt$ (>0) that tends to cause exciting current to flow in the positive direction. In this case, one of the forward switch circuit and the reverse switch circuit is operated so as to produce a voltage $V=R\cdot I-(-d\Phi/dt)$, smaller than $V=R\cdot I$, between the two terminals of the electromagnet. That is, under a condition where the exciting current needs to be increased or maintained, the reverse switch circuit is operated only in the case where the valve steps out. Based on whether the reverse switch circuit is operated under the aforementioned condition, the step-out detection device determines whether the valve has stepped out. Through this technology, it becomes possible to precisely detect the step out of the valve.

In the electromagnetically driven valve control apparatus of the invention, the step-out detection device may detect the step out when a density of magnetic flux produced by the electromagnet is less than a predetermined value at time at which the valve needs to be held adjacent to the electromagnet.

The electromagnet becomes more likely to produce great magnetic flux as the valve approaches the electromagnet. Therefore, when the valve is in the step-out state at a time at which the valve needs to be held adjacent to the electromagnet, the density of the magnetic flux produced by the electromagnet becomes less than that produced when the valve is properly held adjacent to the electromagnet. The step-out detection device determines whether the valve has stepped out on the basis of whether the electromagnet produces a proper density of magnetic flux. Through this technology, it becomes possible to precisely detect the step out of the valve.

The electromagnetically driven valve control apparatus of the invention may further include a reverse switch circuit that applies a voltage to the electromagnet in a reverse direction, a demagnetizing voltage applying device for operating the reverse switch circuit for a predetermined length of time when the valve needs to separate from the electromagnet, and a hold state determining device for determining whether the valve was held adjacent to the electromagnet on the basis of a state of an exciting current flowing through the electromagnet after operation of the reverse switch circuit.

In this control apparatus, when the valve needs to separate from the electromagnet, a voltage in the reverse direction is applied to the electromagnet by operating the reverse switch circuit. If the valve is properly attracted to the electromagnet before the reverse voltage is applied to the electromagnet, a great inductance in the electromagnet is secured. In this case, therefore, after the application of the voltage in the reverse direction, the exciting current exhibits a gently decreasing tendency.

Conversely, if the valve is in the step out state, that is, apart from the electromagnet, before the application of the reverse voltage, the inductance in the electromagnet becomes small. In this case, after the application of the voltage in the reverse direction, the exciting current exhibits a sharply decreasing tendency. In this manner, the exciting current exhibits different changing patterns after the application of the reverse voltage, depending on whether the valve is in the step out state before the application of the reverse voltage. Based on the different changing patterns of the exciting current, the step-out detection device detects the step out of the valve.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the present invention will be described in detail hereinafter with reference to the accompanying drawings.

Figure 1:
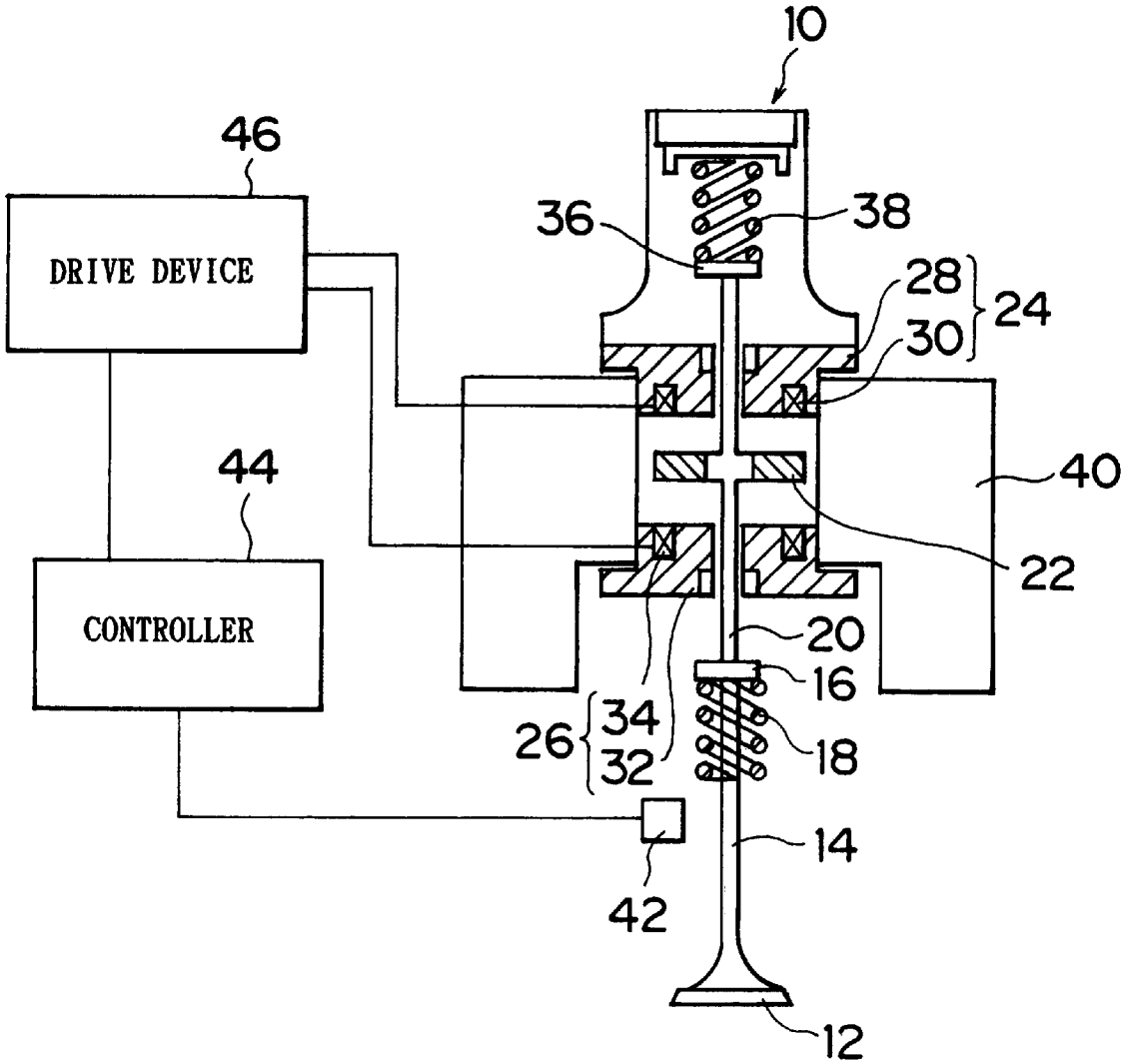
FIG. 1 shows a system construction of an electromagnetically driven valve according to first, second, fourth, fifth and sixth embodiments of the invention.

FIG. 1 illustrates the system construction of an electromagnetically driven valve 10 according to a first embodiment of the invention. The electromagnetically driven valve 10 has a valve 12 that may be used as an intake valve or an exhaust valve of an internal combustion engine. The valve 12 is disposed in an intake or exhaust port of the internal combustion engine in such a manner that a bottom surface of the valve 12 is exposed to a combustion chamber.

The valve 12 is formed together with a valve shaft 14 as a single unit. An upper end of the valve shaft 14 is fixed to a lower retainer 16. A lower spring 18 is disposed under the lower retainer 16 so as to urge the valve 12 in a valve closing direction (upward in FIG. 1). An armature shaft 20 is disposed on top of the lower retainer 16.

The armature shaft 20 is formed from a non-magnetic material. An armature 22 is fixed to the armature shaft 20. The armature 22 is an annular member formed from a magnetic material. An upper electromagnet 24 and a lower electromagnet 26 are disposed above and below the armature 22, respectively. The upper electromagnet 24 has an upper core 28 and an upper coil 30, and the lower electromagnet 26 has a lower core 32 and a lower coil 34.

An upper end of the armature shaft 20 is fixed to an upper retainer 36. An upper spring 38 is disposed on top of the upper retainer 36. The upper spring 38 urges the upper retainer 36 and therefore urges the valve 12 in the valve opening direction (downward in FIG. 1).

The upper electromagnet 24 and the lower electromagnet 26 are disposed in a predetermined positional relationship that is defined by a housing 40. The upper spring 38 and the lower spring 18 of the electromagnetically driven valve 10 are adjusted so that the neutral position of the armature 22 substantially coincides with the midpoint between the upper electromagnet 24 and the lower electromagnet 26. The electromagnetically driven valve 10 is designed so that when the armature 22 contacts the upper electromagnet 24, the valve 12 completely closes the port of the internal combustion engine.

In the system of this embodiment, a valve position sensor 42 is disposed near the valve shaft 14. The valve position sensor 42 outputs an electric signal in accordance with the position of the valve 12. The output signal of the valve position sensor 42 is supplied to a controller 44. Based on the signal from the valve position sensor 42, the controller 44 detects the position of the valve 12.

The controller 44 is connected to a drive device 46 that is connected to the upper coil 30 and the lower coil 34. In accordance with an instruction from the controller 44, the drive device 46 applies an appropriate drive voltage between the two terminals of the upper coil 30 or the lower coil 34, so that an exiting current in accordance with the drive voltage flows therethrough.

When an exciting current flows through the upper coil 30, an electromagnetic force is produced between the upper electromagnet 24 and the armature 22. Likewise, when an exciting current flows through the lower coil 34, an electromagnetic force is produced between the lower electromagnet 26 and the armature 22. Therefore, by supplying exciting currents alternately to the upper coil 30 and the lower coil 34, the valve 12 can be suitably operated in the opening and closing directions.

Figures 2A, 2B:
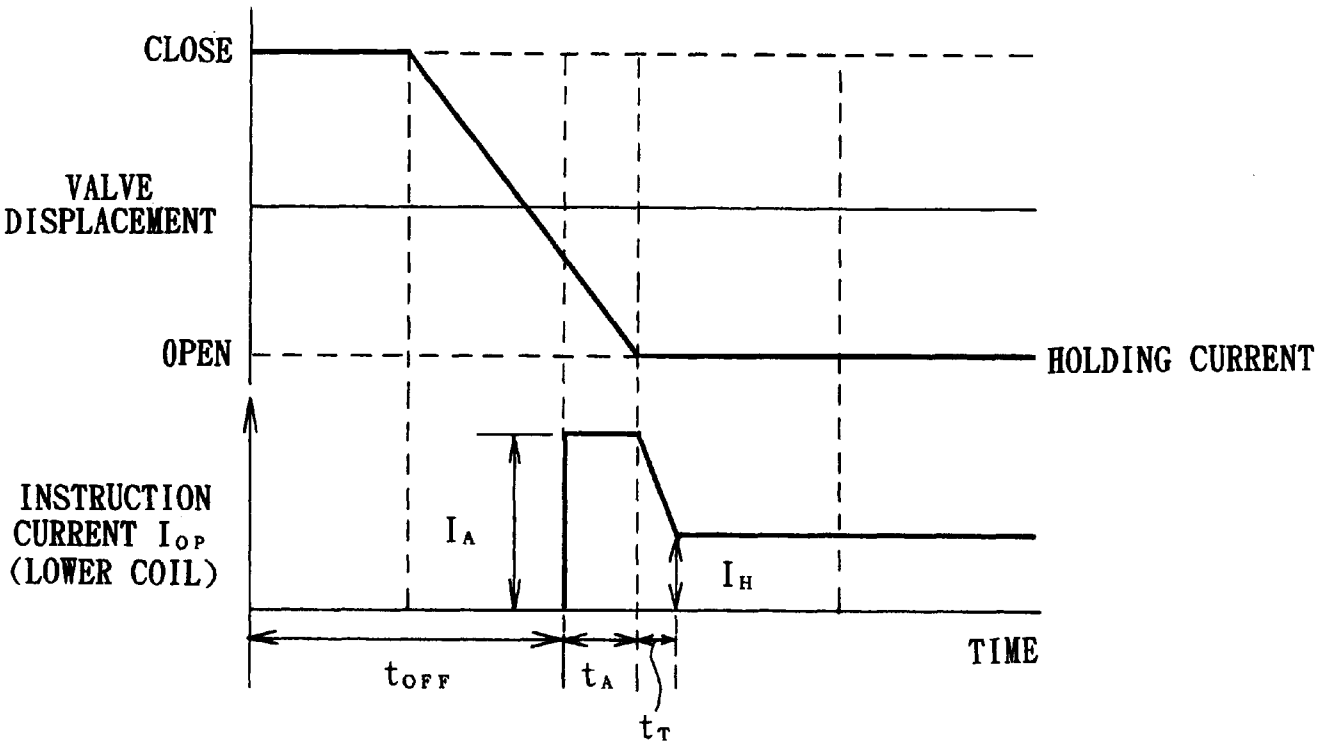
FIG. 2A is a time chart indicating the displacement of the valve of the electromagnetically driven valve of the first embodiment.
FIG. 2B is a time chart indicating the instruction current $I_{op}$ to a lower coil of the electromagnetically driven valve of the first embodiment.

FIG. 2A is a time chart indicating the displacement of the valve 12. FIG. 2B is a time chart of the instructed value of exciting current (hereinafter, referred to as "instruction current $I_{op}$") to be supplied to the lower coil 34. The time charts of FIGS. 2A and 2B indicate $I_{op}$ conducted when the valve 12 is moved from the completely closed position to the fully open position. As indicated in FIGS. 2A and 2B, the instruction current $I_{op}$ is maintained at "0" for a predetermined off-period $t_{OFF}$ following the output of a valve opening instruction for the valve 12. The length of off-period $t_{OFF}$ is pre-set so as to elapse at a time point at which the valve 12, urged by the upper spring 38 and the lower spring 18, moves to a point that is a predetermined distance apart from the completely closed position.

After the off-period $t_{OFF}$, the instruction current $I_{op}$ is maintained at an attracting current $I_A$ for an attracting period $t_A$, and then gradually reduced to a holding current $I_H$ over a predetermined transition period $t_T$. The attracting period $t_A$ is pre-set to a length of time that is needed for the valve 12 to reach the fully open position. The attracting current $I_A$ is pre-set as an instruction current $I_{op}$ that is needed to produce an electromagnetic force necessary to draw the moving valve 12 to the fully open position. The holding current $I_H$ is pre-set as an instruction current $I_{op}$ needed to produce an electromagnetic force necessary to hold the valve 12 at the fully open position after the arrival of the valve 12 at the fully open position.

Through the control of the instruction current $I_{op}$ as described above, a great electromagnetic force is produced between the armature 22 and the lower electromagnet 26 during the displacement of the valve 12 toward the fully open position. Furthermore, after the arrival of the valve 12 at the fully open position, an electromagnetic force sufficient to hold the valve 12 at the fully open position can be produced without consumption of an unnecessary amount of power. Therefore, the control of the instruction current $I_{op}$ in the manner described above makes it possible to hold the valve 12 at the fully open position by a reduced amount of power consumption.

During the displacement of the valve 12 from the completely closed position to the fully open position, the controller 44 controls the instruction current $I_{op}$ supplied to the lower coil 34 in the manner described above and, furthermore, controls the instruction current $I_{op}$ supplied to the upper coil 30 in a similar manner. Therefore, the electromagnetically driven valve 10 of this embodiment can be properly opened and closed by using reduced amounts of power.

Figure 3:
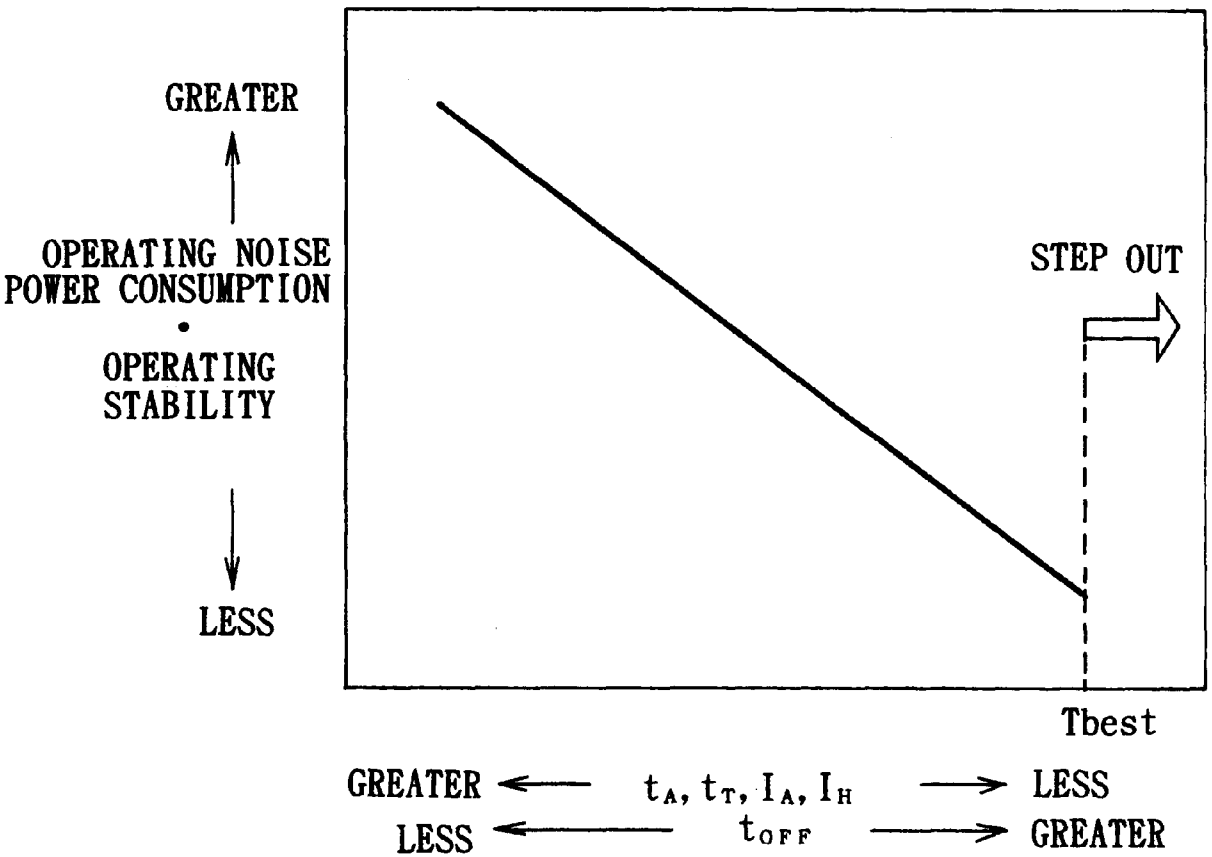
FIG. 3 is a graph indicating the characteristics of the electromagnetically driven valve of the first embodiment.

FIG. 3 indicates the relationship between the waveform of the instruction current $I_{op}$ to the electromagnetically driven valve 10 and the characteristics of the electromagnetically driven valve 10. More specifically, the graph of FIG. 3 indicates the relationship between the instruction current $I_{op}$ and the operation noise of the electromagnetically driven valve 10, the relationship between the instruction current $I_{op}$ and the power consumption of the electromagnetically driven valve 10, and the relationship between the instruction current $I_{op}$ and the operation stability of the electromagnetically driven valve 10.

The valve 12 of the electromagnetically driven valve 10 becomes seated on a valve seat upon reaching the completely closed position. The armature 22 of the electromagnetically driven valve 10 contacts the upper electromagnet 24 or the lower electromagnet 26 upon reaching the fully open position or the completely closed position. At the time of arrival at the completely closed position or the fully open position, the electromagnetically driven valve 10 produces noise due to the seating of the valve 12 or the contact of the armature 22 with the upper electromagnet 24 or the lower electromagnet 26. The thus-produced noise becomes greater as the electromagnetic force acting on the armature 22 at the time of arrival of the valve 12 at either displacement end increases.

The electromagnetic force that acts on the armature 22 increases as the instruction current $I_{op}$ increases. Therefore, the operation noise of the electromagnetically driven valve 10 can be made less by reducing the instruction current $I_{op}$ as indicated in FIG. 3, more specifically, by increasing the off-period $t_{OFF}$, during which the instruction current $I_{op}$ is maintained at zero, and by reducing the attracting period $t_A$ and the transition period $t_T$, and by reducing the attracting current $I_A$ and the holding current $I_H$.

Likewise, the power consumption of the electromagnetically driven valve 10 can be made less by reducing the instruction current $I_{op}$, more specifically, by increasing the off-period $t_{OFF}$ of the instruction current $I_{op}$, and reducing the attracting period $t_A$ and the transition period $t_T$, and reducing the attracting current $I_A$ and the holding current $I_H$.

However, as the instruction current $I_{op}$, is reduced, the step out of the valve 12 becomes more likely. Thus, the operation stability of the electromagnetically driven valve 10 becomes more degraded as the instruction current $I_{op}$ is reduced as indicated in FIG. 3, more specifically, as the off-period $t_{OFF}$ of the instruction current $I_{op}$ is increased, and as the attracting period $t_A$ and the transition period $t_T$ are reduced, and as the attracting current $I_A$ and the holding current $I_H$ are reduced.

Consequently, in order to achieve good power economy and high operation stability in the electromagnetically driven valve 10, it is appropriate to control the waveform of the instruction current $I_{op}$ to a minimum waveform such that the step out of the valve 12 will not occur. However, the minimum electromagnetic force that avoids the step out of the valve 12 can greatly vary even when environmental conditions, for example, the operating conditions of the internal combustion engine, remain unchanged. For example, the minimum electromagnetic force will greatly vary with changes in the fuel combustion condition and the like.

Therefore, it is normally difficult to precisely set a minimum instruction current $I_{op}$ on the basis of the environmental conditions, such as the operating conditions of an internal combustion engine, and the like. However, the electromagnetically driven valve 10 of this embodiment has an excellent feature of controlling the instruction current $I_{op}$ to a minimum and sufficient value as described above in the following manner. That is, during the operation of the internal combustion engine, the electromagnetically driven valve 10 of the embodiment determines whether there is a step out of the valve 12, and corrects the waveform of the instruction current $I_{op}$ on the basis of the result of this determination regarding step out.

The operations for realizing the aforementioned characteristic function of the embodiment will be described with reference to FIGS. 4 and 5.

Figure 4:
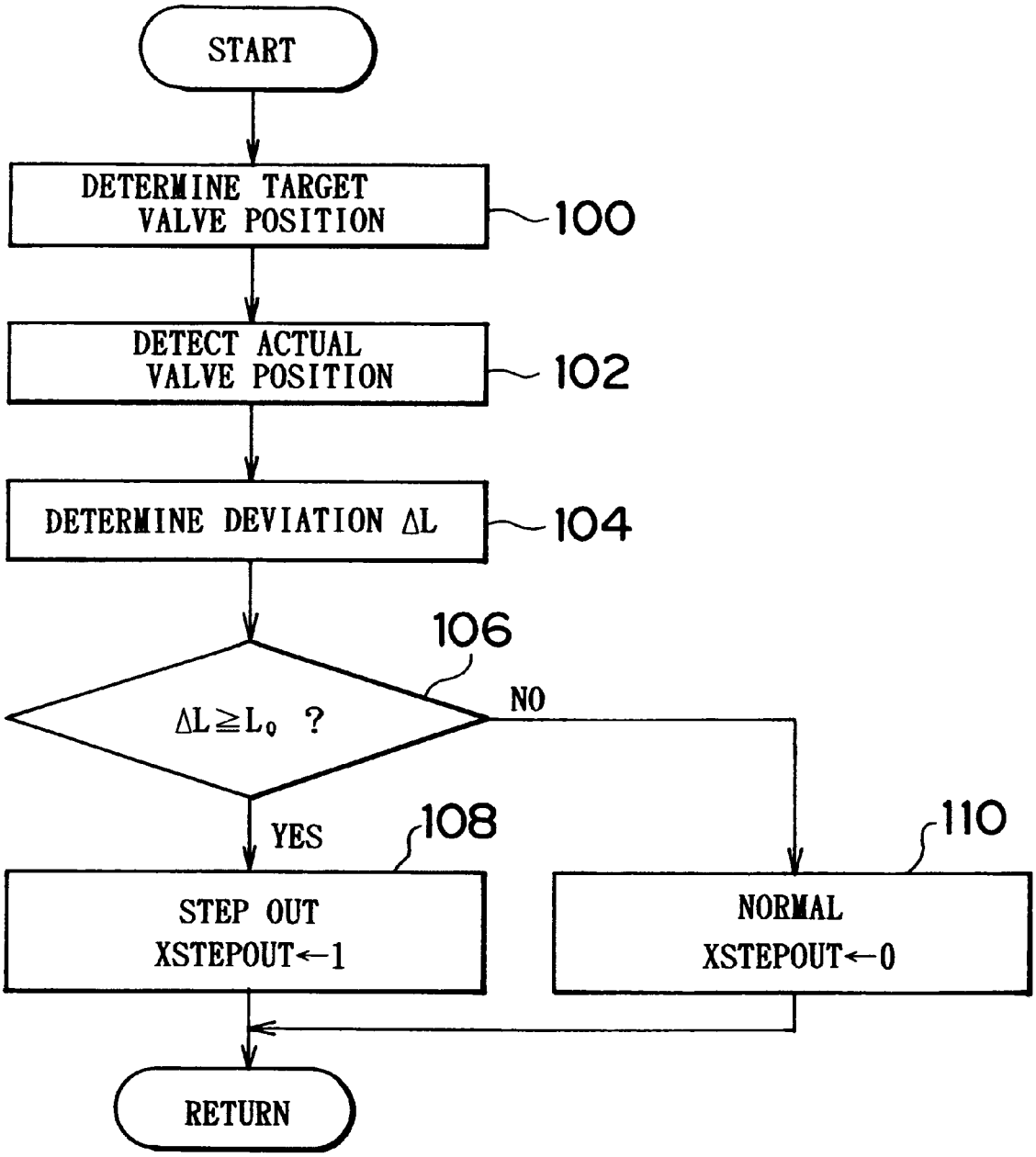
FIG. 4 is a flowchart illustrating a control routine executed to detect the step out of the valve in the electromagnetically driven valve of the first embodiment.

FIG. 4 shows a flowchart of a control routine performed by the controller 44 for detecting a step out, more specifically, for determining whether the valve 12 is undergoing step out. The routine illustrated in FIG. 4 is an interrupt routine that is repeatedly performed at predetermined intervals. When the routine illustrated in FIG. 4 is started, the processing of step 100 is first executed.

In step 100, a target valve position is determined in the following manner. The controller 44 outputs valve opening and closing requests for the valve 12 at appropriate timings synchronous to the crank angle of the internal combustion engine. The relationship between the elapsed time following the output of either request and the target valve position is pre-stored in the controller 44. Based on the relationship, the controller 44 determines the target valve position in step 100.

In step 102, the controller 44 detects an actual valve position based on an output signal of the valve position sensor 42.

In step 104, the controller 44 determines a deviation $\Delta L$ of the actual valve position from the target valve position.

In step 106, it is determined whether the deviation $\Delta L$ is equal to or greater than a predetermined threshold $L_0$. If $\Delta L \geqq L_0$ holds, it is considered that the actual position of the valve 12 is greatly deviated from the target valve position. In this case, operation proceeds to step 108. Conversely, if $\Delta L \geqq L_0$ does not hold, it is considered that the actual position of the valve 12 substantially coincides with the target valve position. In this case, operation proceeds to step 110.

In step 108, the controller 44 sets a step-out flag XSTEPOUT to "1" in order to indicate that the step out of the valve 12 is occurring. After step 108, the present execution of the routine ends.

In step 110, the controller 44 rests the step-out flag XSTEPOUT to "0" in order to indicate that the step out of the valve 12 is not occurring. After step 110, the present execution of the routine ends.

Through this routine, it is possible to properly set the step-out flag XSTEPOUT to "1" or "0" corresponding to whether the step out of the valve 12 is occurring or not.

Figure 5:
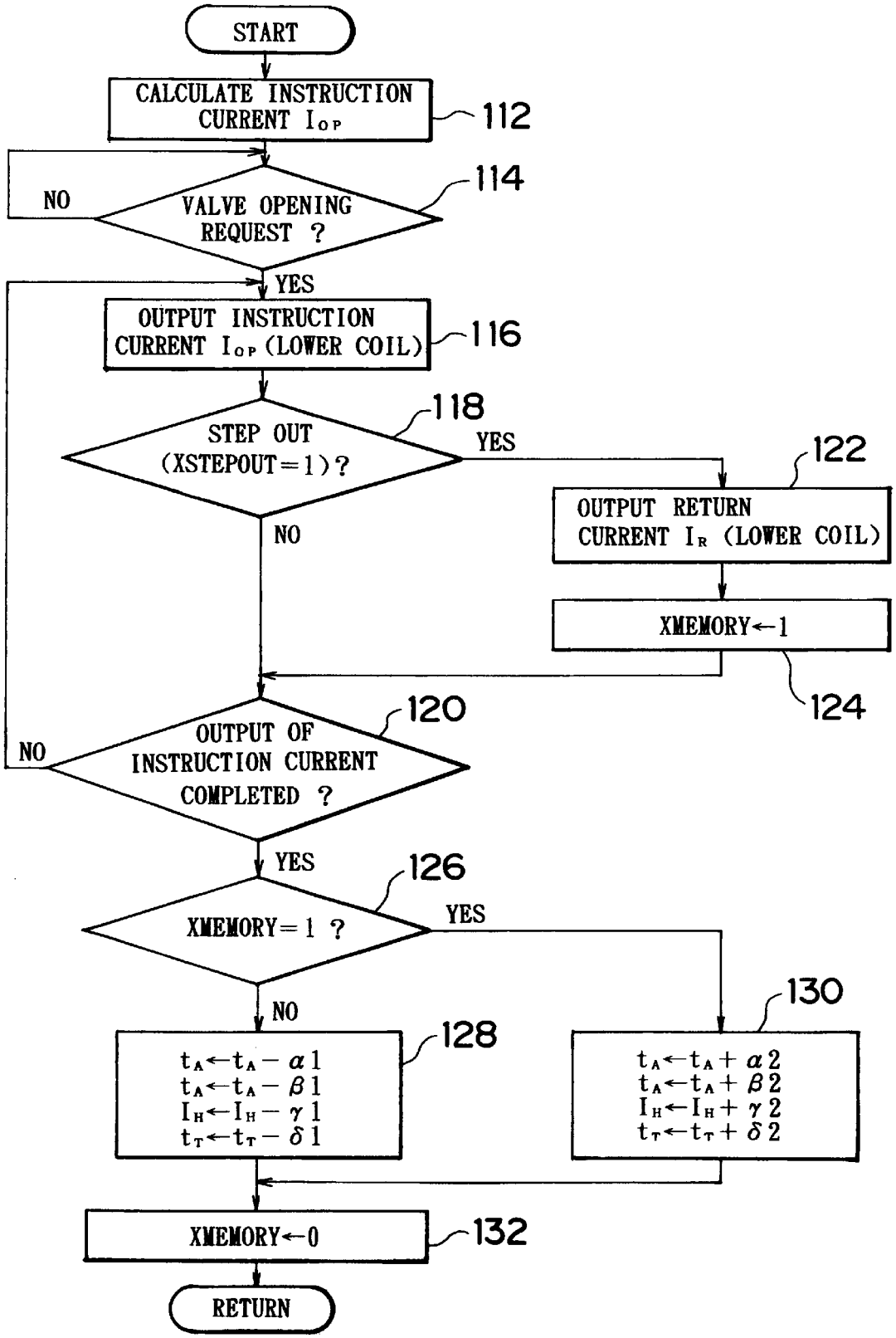
FIG. 5 is a flowchart illustrating a control routine executed to update the instruction current $I_{op}$ in the electromagnetically driven valve of the first embodiment.

FIG. 5 shows a flowchart of a control routine executed by the controller 44 in order to control the instruction current $I_{op}$ for the lower coil 34 to a minimum value. The routine illustrated in FIG. 5 is repeatedly performed, more specifically, started every time the routine ends. When the routine of FIG. 5 is started, the processing of step 112 is first executed.

In step 112, the controller 44 calculates the waveform of the instruction current $I_{op}$ for the lower coil 34. The waveform determined in step 112 is a waveform of the instruction current $I_{op}$ for displacing the valve 12 from the completely closed position to the fully open position and for then holding the valve 12 at the fully open position for a predetermined length of time. Hereinafter, the aforementioned series of condition changes will be referred to as "the valve opening cycle of the valve 12".

In this embodiment, the controller 44 calculates various parameters that define the waveform of the instruction current $I_{op}$, along with the progress of the valve opening cycle of the valve 12. In step 112, the instruction current $I_{op}$ is calculated on the basis of the various parameters calculated at the time of the previous valve opening cycle, in such a manner that the calculated waveform of the instruction current $I_{op}$ will not be less than a predetermined basic waveform. This manner of processing will provide a proper waveform of the instruction current $I_{op}$ while ensuring that the waveform will surpass the basic waveform or at least equal the basic waveform. The contents of the various parameters and the calculation method will be described in detail later.

In step 114, it is determined whether the valve opening request concerning the valve 12 is outputted. The processing of step 114 is repeatedly executed until it is determined that the valve opening request concerning the valve 12 is outputted. When it is determined so, operation proceeds to step 116.

In step 116, the controller 44 outputs an instruction current $I_{OP}$ in accordance with the waveform calculated in step 112. When the processing of step 116 has been executed, the exiting current through the lower coil 34 is controlled by the drive device 46 so as to equal the instruction current $I_{OP}$.

In step 118, it is determined whether the step out of the valve 12 is occurring, more specifically, whether the step-out flag XSTEPOUT has been set to "1". If it is determined that the step out of the valve 12 is not occurring, operation proceeds to step 120.

In step 120, it is determined whether the output of the instruction current $I_{OP}$ necessary for the valve opening cycle of the valve 12 has been completed. If it is determined that the output of the instruction current $I_{OP}$ has not been completed, operation goes back to step 116. In this manner, the controller 44 performs the operation of changing the instruction current $I_{OP}$ in accordance with the waveform calculated in step 112, if the step out of the valve 12 is not detected.

If the valve 12 undergoes step out during a valve opening cycle of the valve 12, the processing of step 118 is followed by the processing of step 122.

In step 122, the controller 44 holds the instruction current $I_{OP}$ at a predetermined return current $I_R$ for a predetermined length of time. The return current $I_R$ is set greater than the attracting current $I_A$. If the valve 12 steps out during a valve opening cycle, the valve 12 is located at a closed-position side of the target valve position. In order to bring the valve 12 closer to the target valve position under this condition, it is necessary to control the instruction current $I_{op}$ to a value that is greater than the attracting current $I_A$. This requirement is met by executing the processing of step 122, so that the valve 12 can be brought from the step-out condition back to a normal condition.

In step 124, the controller 44 sets a memory flag XMEMORY to "1". The memory flag XMEMORY indicates by "1" that the valve 12 has stepped out during a valve opening cycle. After step 124, operation proceeds to the above-described processing of step 120.

If it is determined in step 120 that the output of the instruction current $I_{OP}$ has been completed, operation proceeds to step 126.

In step 126, it is determined whether the memory flag XMEMORY is "1". If XMEMORY=1 is not established, it is considered that the valve 12 did not step out during the present valve opening cycle. In this case, it is considered that the instruction current $I_{op}$ used during the present valve opening cycle was sufficient with regard to the present conditions of the internal combustion engine. Then, operation proceeds to step 128. Conversely, if it is determined in step 118 that XMEMORY=1 holds, it is considered that the instruction current $I_{OP}$ used during the present valve opening cycle was insufficient with regard to the present conditions of the internal combustion engine. Then, operation proceeds to step 130.

In step 128, the controller 44 reduces the instruction current $I_{OP}$. More specifically, the controller 44 reduces the attracting period $t_A$ and the transition period $t_T$, and reduces the attracting current $I_A$ and the holding current $I_H$ in step 128. In this embodiment, the off period $t_{OFF}$, the attracting period $t_A$ and the transition period $t_T$ regarding the instruction current $I_{OP}$ are variably set so that the total time length of these periods remains at a fixed value. Therefore, through the processing of step 128, the off period $t_{OFF}$ is increased.

In the operation described above, if the instruction current $I_{OP}$ is sufficient during the present valve opening cycle, it is possible to correct the instruction current $I_{OP}$ for the next valve opening cycle to reduced values. Therefore, the above-described operation according to this embodiment is able to prevent an event that an excessively great value of instruction current $I_{OP}$ is maintained.

If it is determined that the memory flag XMEMORY is "1", that is, if it is determined that the valve 12 has stepped out during the present valve opening cycle, operation proceeds to step 130. In step 130, the controller 44 increases the instruction current $I_{OP}$. More specifically, the controller 44 increases the attracting period $t_A$ and the transition period $t_T$, and increases the attracting current $I_A$ and the holding current $I_H$ in step 130. Through the processing of step 130, the off period $t_{OFF}$ is reduced.

In the operation described above, if the instruction current $I_{OP}$ during the present valve opening cycle is insufficient or too small, it is possible to correct the instruction current $I_{OP}$ for the next valve opening cycle to increased values. Therefore, the operation according to this embodiment is able to increase the instruction current $I_{OP}$ to such a value that the step out of the valve 12 can be avoided, if it becomes difficult to properly operate the valve 12 due to the effect of external disturbances on the valve 12.

FIGS. 6A through 9B show time charts indicating various manners of operation of the electromagnetically driven valve 10 executed in different valve opening cycles by the control routines described above. FIGS. 6A, 7A, 8A and 9A are time charts indicating the operation of the valve 12. FIGS. 6B, 7B, 8B and 9B are time charts indicating the changes of the instruction current to the lower coil 34.

Figure 6A:
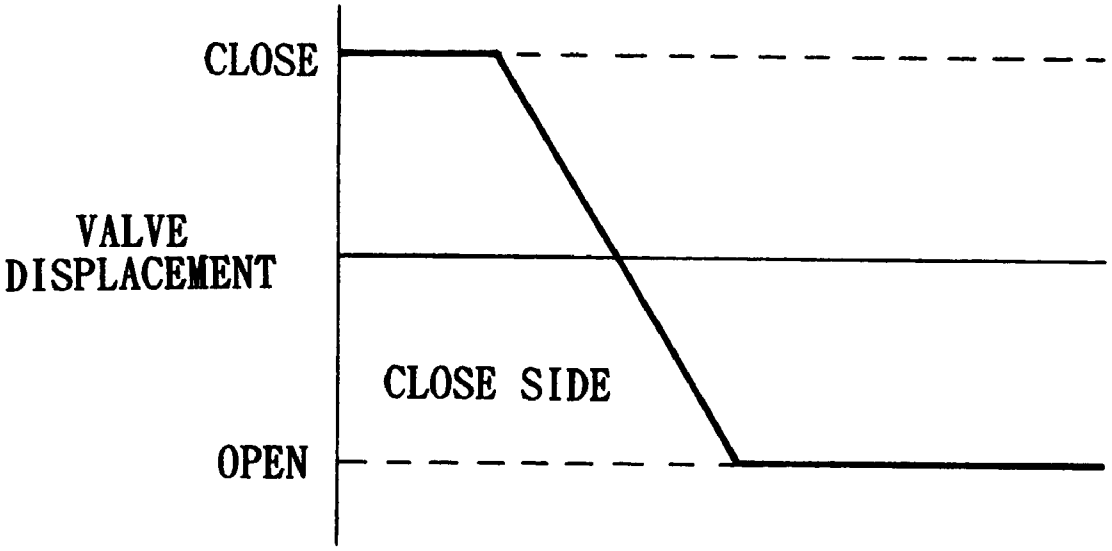
FIG. 6A is a time chart indicating the displacement of the valve of the electromagnetically driven valve of the first embodiment during the Nth cycle.
Figure 6B:
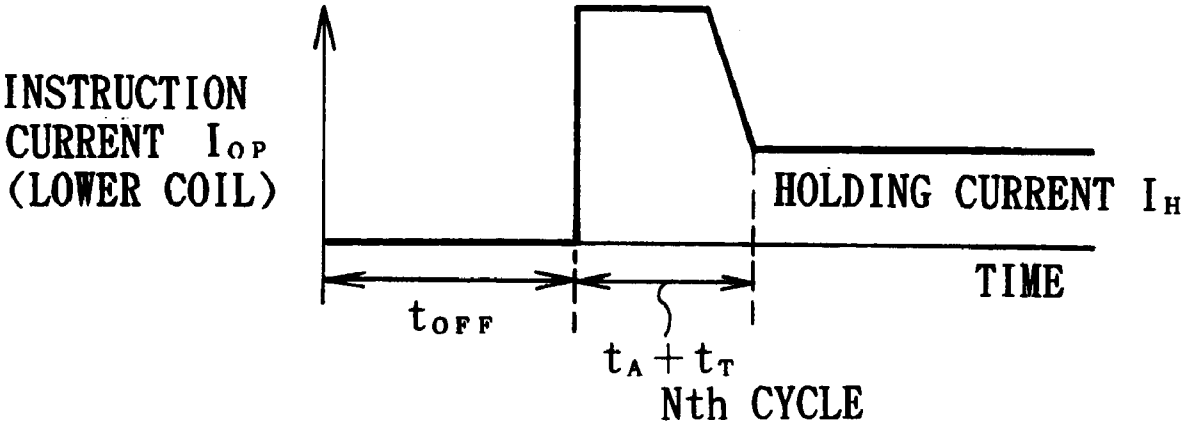
FIG. 6B is a time chart indicating the instruction current $I_{op}$ to the lower coil in the electromagnetically driven valve of the first embodiment during the Nth cycle.
Figures 7A, 7B:
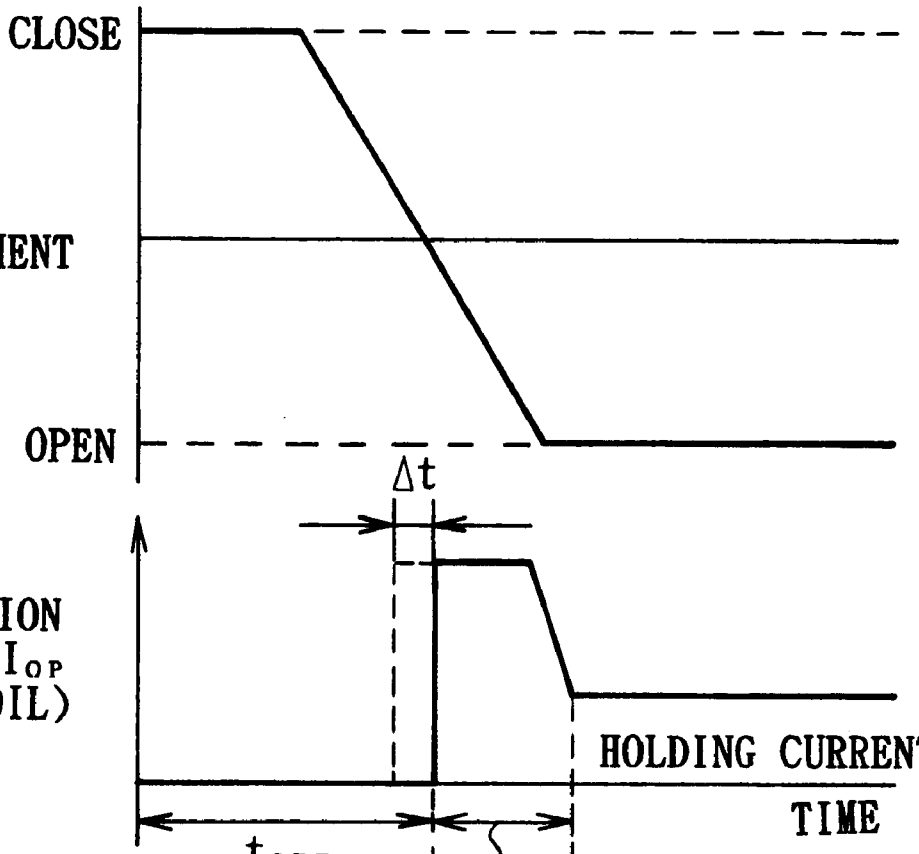
FIG. 7A is a time chart indicating the displacement of the valve of the electromagnetically driven valve of the first embodiment during the (N+1)th cycle.
FIG. 7B is a time chart indicating the instruction current $I_{op}$ to the lower coil in the electromagnetically driven valve of the first embodiment during the (N+1)th cycle.

The time charts of FIGS. 6A and 6B indicate the operation in the Nth valve opening cycle, and the time charts of FIGS. 7A and 7B indicate the operation in the (N+1)th valve opening cycle. In the Nth and (N+1)th valve opening cycles, the valve 12 is operated from the closed position to the open position without stepping out, as indicated in the charts. Therefore, as long as such valve opening cycles go on, the instruction current $I_{op}$ updated to a reduced amount every cycle.

Figures 8A, 8B:
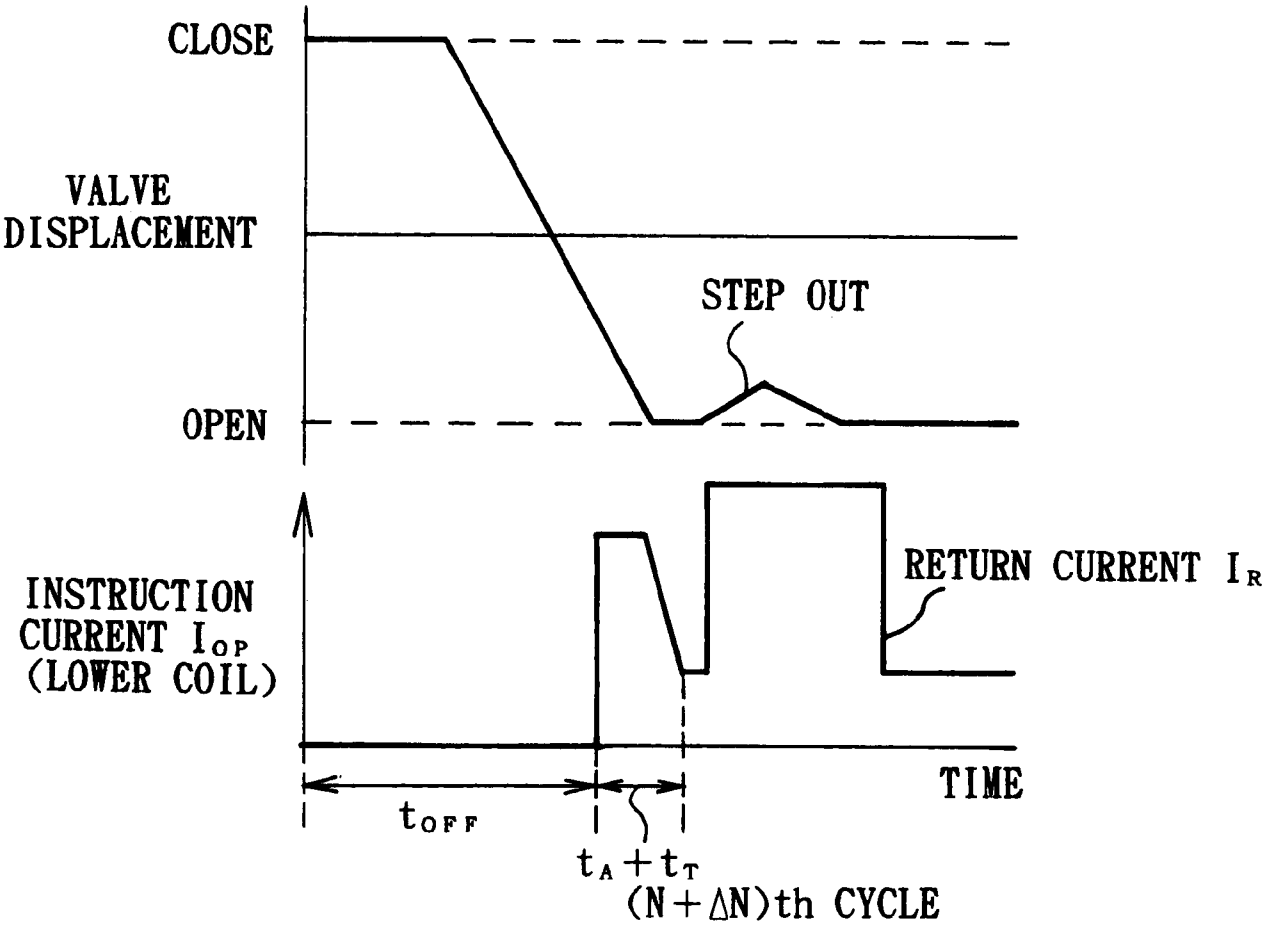
FIG. 8A is a time chart indicating the displacement of the valve of the electromagnetically driven valve of the first embodiment during the (N+ΔN)th cycle.
FIG. 8B is a time chart indicating the instruction current $I_{op}$ to the lower coil in the electromagnetically driven valve of the first embodiment during the (N+ΔN)th cycle.

The time charts of FIGS. 8A and 8B indicate the operation in the (N+ΔN)th valve opening cycle. In this cycle, the valve 12 steps out during the holding period because of the update of the instruction current $I_{op}$ to a reduced amount based on the operation during the previous valve opening cycle. Upon detecting the step out of the valve 12, the electromagnetically driven valve 10 sets the instruction current $I_{op}$ to the return current. FIGS. 8A and 8B indicate the operation where the valve 12 returns from the step out to a normal state due to the control operation described above.

Figure 9A:
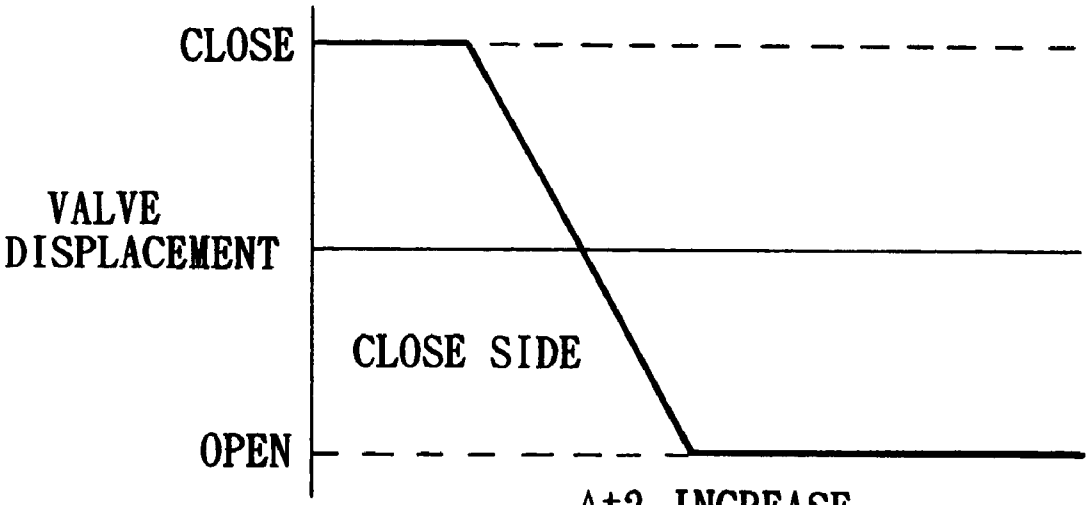
FIG. 9A is a time chart indicating the displacement of the valve of the electromagnetically driven valve of the first embodiment during the (N+ΔN+1)th cycle.
Figure 9B:
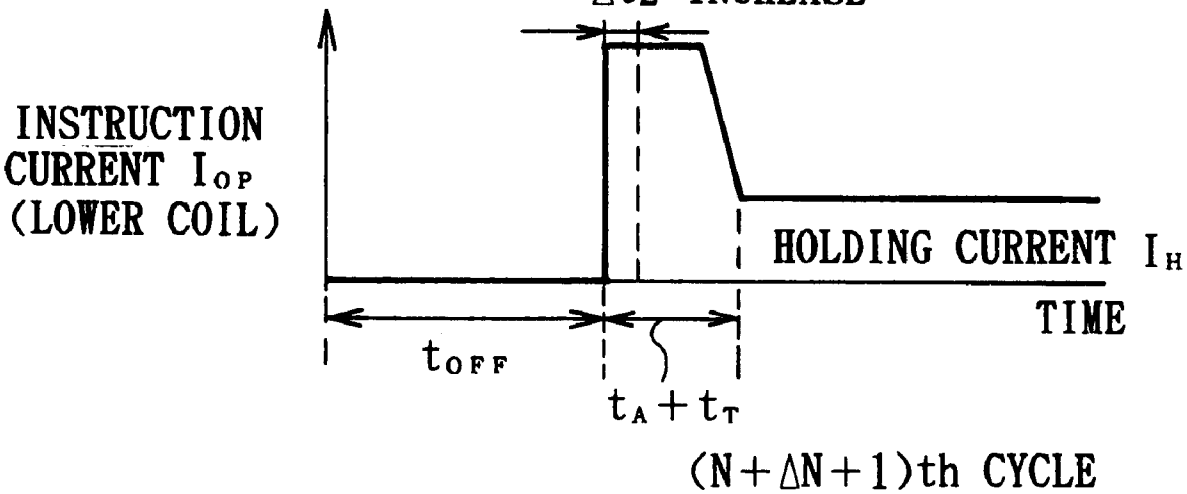
FIG. 9B is a time chart indicating the instruction current $I_{op}$ to the lower coil in the electromagnetically driven valve of the first embodiment during the (N+ΔN+1)th cycle.

The time charts of FIGS. 9A and 9B indicate the operation in the (N+ΔN+1)th valve opening cycle. The instruction current $I_{op}$ used in this cycle is updated from the instruction current $I_{op}$ used in the previous cycle to an increased amount. Therefore, in the (N+ΔN+1)th cycle, the valve 12 can be operated to the fully open position without step out, and can be properly held at the fully open position for a predetermined length of time.

In this manner, the electromagnetically driven valve 10 according to this embodiment is able to achieve a minimum and sufficient waveform of the instruction current $I_{op}$ to the lower coil 34 without causing the valve 12 to step out during valve opening cycles.

That is, the electromagnetically driven valve 10 of this embodiment always controls the instruction current $I_{op}$ to the upper coil 30 and the lower coil 34 to minimum and sufficient values while repeating the opening and closing operations of the valve 12. Therefore, the electromagnetically driven valve 10 of this embodiment can reduce unnecessary power consumption and achieve an excellent power economy characteristic, while ensuring reliable opening and closing operation of the valve 12.

Although in the foregoing embodiment, the waveform of the instruction current $I_{op}$ is corrected by changing all of the attracting period $t_A$, the attracting current $I_A$, the holding current $I_H$ and the transition period $t_T$, the present invention is not restricted by this manner of correction. For example, it is also possible to correct the instruction current $I_{op}$ by changing only some of the parameters.

A second embodiment of the invention will be described with reference to FIGS. 10 through 12.

In the first embodiment, the instruction current $I_{op}$ is increased or reduced at every set of a valve opening cycle and the subsequent valve closing cycle of the valve 12, as described above. The control operation in this manner controls the instruction current $I_{op}$ to a minimum value, but may frequently cause an event that requires the return current $I_R$. In order to prevent such frequent requests for the return current $I_R$, a system according to the second embodiment maintains an increased instruction current $I_{op}$ for a predetermined period of time after an increase of the instruction current $I_{op}$ has been requested.

Figure 10:
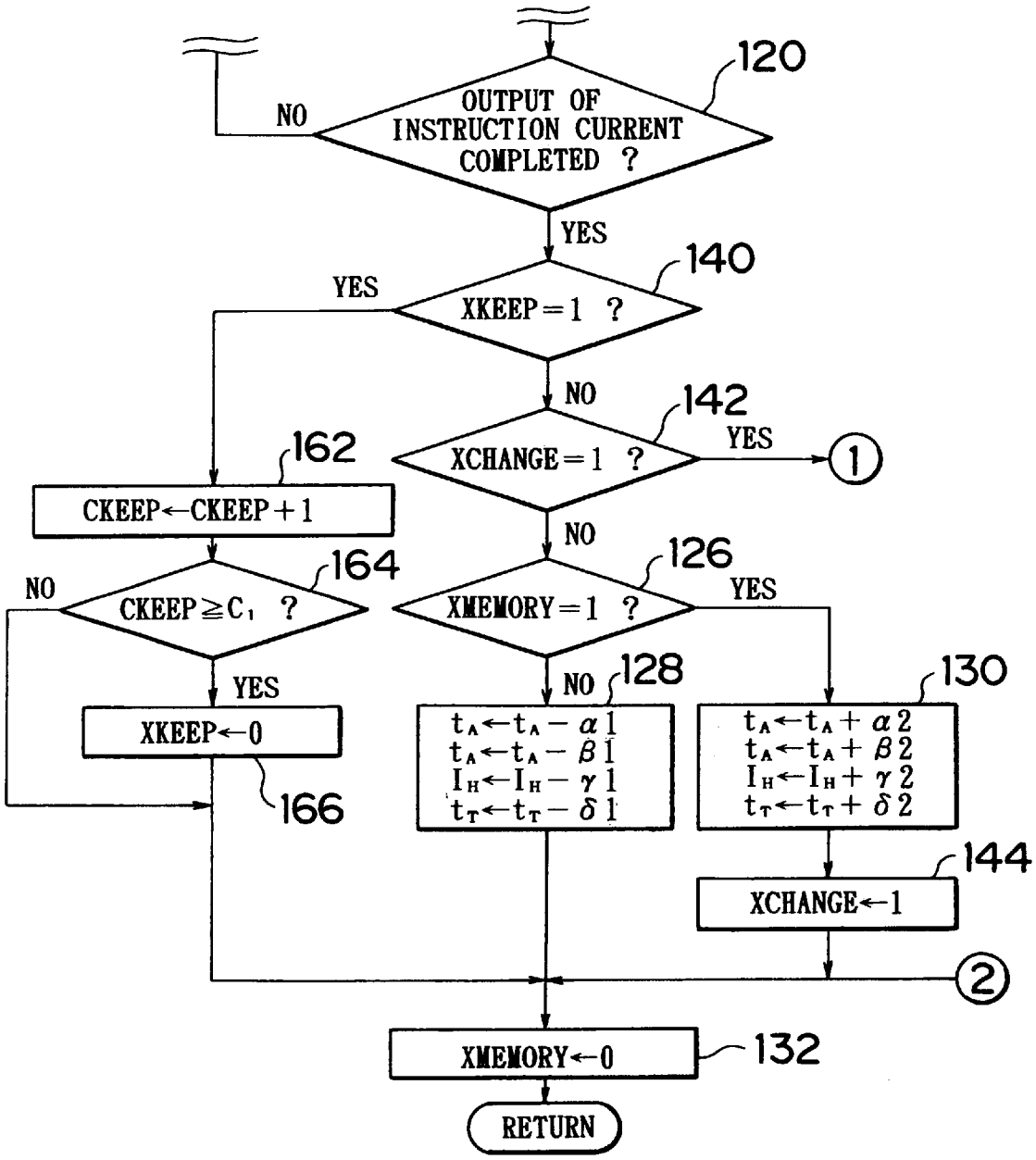
FIGS. 10 and 11 show a flowchart illustrating a control routine executed to update the instruction current $I_{op}$ in an electromagnetically driven valve of the second embodiment.
Figure 11:
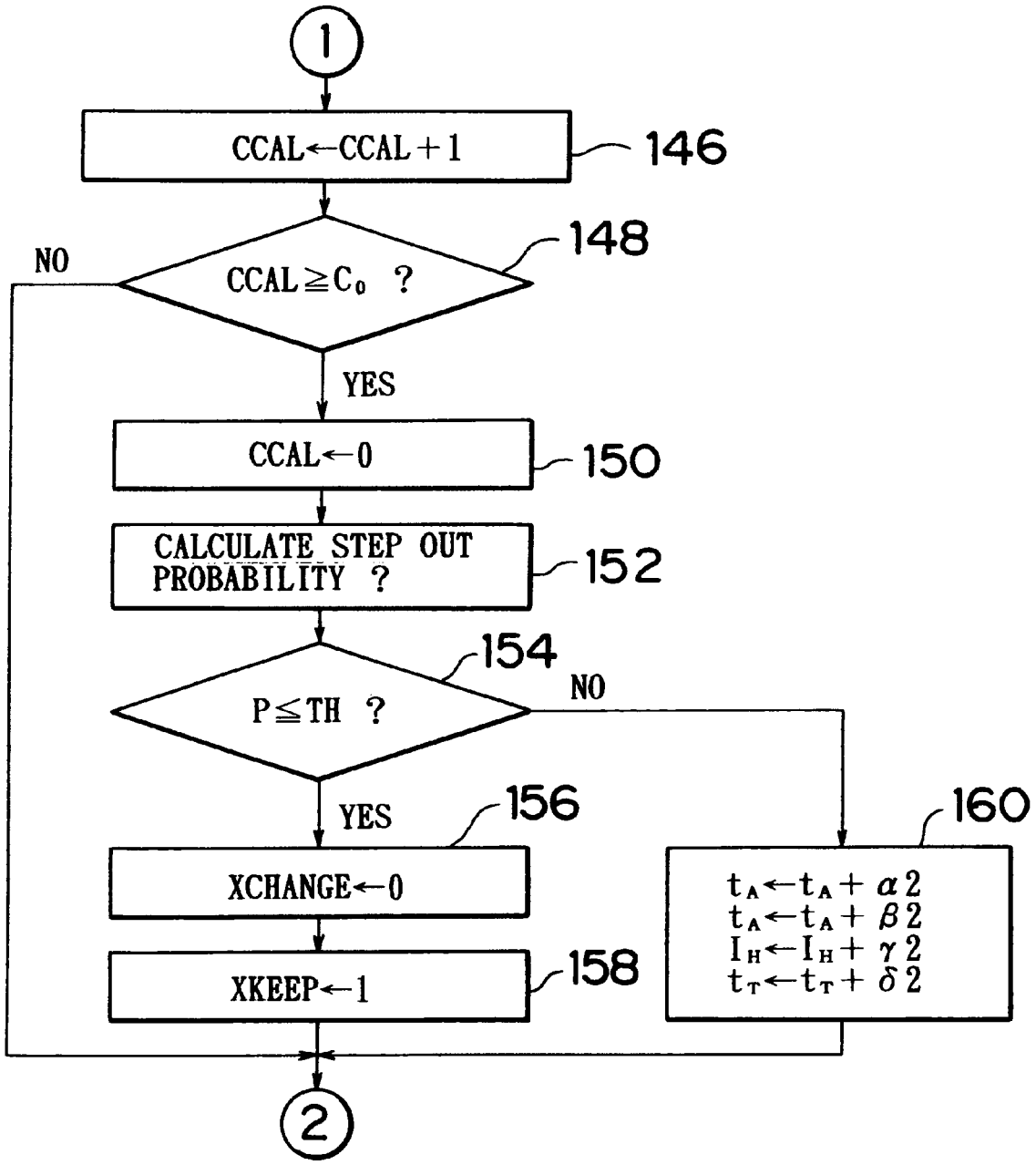

FIGS. 10 and 11 show a flowchart of a series of operations performed in the second embodiment in order to realize the aforementioned function. The system of this embodiment has a system construction as shown in FIG. 1, and causes the controller 44 to perform operations illustrated in FIGS. 10 and 11 instead of the operation of steps 126 through 132 following step 120 shown in FIG. 5. The steps comparable to those in FIG. 5 are represented by comparable reference numerals in FIGS. 10 and 11, and will not be described again.

As shown in FIG. 10, when the controller 44 determines in step 120 that the output of the instruction current $I_{op}$ has been completed, operation subsequently proceeds to step 140 in the second embodiment.

In step 140, the controller 44 determines that a keep flag XKEEP has been set to "1". The keep flag XKEEP is a flag that is set to "1" when it is appropriate to maintain the instruction current $I_{op}$, without increasing or reducing it. Therefore, if XKEEP=1 does not hold, it can be considered that it is appropriate to update the instruction current $I_{op}$. In this case, operation proceeds to step 142.

In step 142, it is determined that a change flag XCHANGE has been set to "1". The change flag XCHANGE is a flag that is set to "1" when the instruction current $I_{op}$ is updated to an increased amount. Therefore, if the instruction current $I_{op}$ was not updated to an increased amount at the time of the previous operation cycle, it is determined that XCHANGE=1 is not established. In this case, operation proceeds to step 126.

In steps 126 through 130, the controller 44 performs the same operations as in the first embodiment. That is, if the step out of the valve 12 is not detected in the present operation cycle (XMEMORY=0), the instruction current $I_{op}$ is reduced in step 128. If the step out is detected (XMEMORY=1), the instruction current $I_{op}$ is increased in step 130. If the processing of step 128 is executed, the processing of step 132 is subsequently executed, and then the present execution of the routine ends. If the processing of step 130 is executed, the processing of step 144 and then the processing of step 132 are executed. Subsequently, the present execution of the routine ends.

In step 144, the change flag XCHANGE is set to "1". Through the operation described above, the change flag XCHANGE can reliably be set to "1" if the instruction current $I_{op}$ has been updated to an increased amount.

In a cycle of the routine following the execution of the processing of step 144, the controller 44 determines in step 142 that XCHANGE=1 is established. In this case, operation proceeds to step 146 shown in FIG. 11.

In step 146, a calculation counter CCAL is incremented. The calculation counter CCAL is a counter for counting the number of cycles needed for the evaluation of the instruction current $I_{op}$ that has been updated to an increased amount.

Subsequently in step 148, it is determined whether the count of the calculation counter CCAL is equal to or greater than a predetermined value $C_0$. If it is determined that $CCAL \geqq C_0$ does not hold, it can be considered that the calculation for evaluating the instruction current $I_{op}$ is not completed. In this case, operation jumps to step 132, and then the present cycle of the routine ends. Through the operation described above, the instruction current $I_{op}$ is held at a fixed pattern without being increased or changed until $CCAL \geqq C_0$ is established. When it is determined in step 148 that $CCAL \geqq C_0$ holds, operation proceeds to step 150.

In step 150, the calculation counter CCAL is reset to "0".

Subsequently in step 152, the controller 44 calculates the probability P that the valve 12 could have stepped out between the update of the instruction current $I_{op}$ to an increased amount and the count of the calculation counter CCAL reaching or exceeding $C_0$.

Subsequently in step 154, it is determined whether the probability P is equal to or less than a predetermined threshold TH. If it is determined that $P \leqq TH$ holds, it can be considered that the instruction current $I_{op}$ has been properly set, that is, it can be considered that the instruction current $I_{op}$ has been set to a minimum waveform that avoids the step out of the valve 12. In this case, operation proceeds to step 156.

In step 156, the change flag XCHANGE is reset to "0".

Subsequently in step 158, the keep flag XKEEP is set to "1". Subsequently, the processing of step 132 is executed, followed by the end of the present cycle.

Conversely, if it is determined in step 154 that $P \leqq TH$ does not hold, it can be considered that the instruction current $I_{op}$ is still insufficient or too small. In this case, operation proceeds to step 160.

In step 160, the controller 44 increases the instruction current $I_{op}$ as in step 130 of the first embodiment. Subsequently, the processing of step 132 is executed, followed by the end of the present cycle of the routine. Through the operation described above, the instruction current $I_{op}$ can be increased until the probability P of the step out of the valve 12 becomes equal to or less than the threshold TH.

In a cycle of the routine following the execution of the processing of step 158, the controller 44 determines in step 140 that XKEEP=1 is established. In this case, operation proceeds to step 162.

In step 162, an keep counter CKEEP is incremented. The keep counter CKEEP is provided for counting the elapsed time following the start of keeping the instruction current $I_{op}$.

In step 164, it is determined whether the count of the keep counter CKEEP is equal to or greater than a predetermined value $C_1$. If $CKEEP \geqq C_1$ does not hold, it can be considered that the time to update the instruction current $I_{op}$ has not come. In this case, the processing of step 132 is subsequently executed, followed by the end of the present cycle of the routine. Conversely, if it is determined in step 164 that $CKEEP \geqq C_1$ holds, operation proceeds to step 166.

In step 166, the keep flag XKEEP is reset to "0". Subsequently, the processing of step 132 is executed, followed by the end of the present cycle of the routine. In the cycle of the routine after the execution of step 166, the controller 44 executes step 142 and the following steps.

Through the operation described above, the instruction current $I_{op}$ can be updated to a minimum pattern that avoids the step out of the valve 12 and, furthermore, the updated proper instruction current $I_{op}$ can be maintained for a predetermined period of time. Consequently, the system of this embodiment is able to control the instruction current $I_{op}$ to a minimum pattern, that is, provide the electromagnetically driven valve 10 with excellent operation stability and an excellent power economy characteristic, without frequently requesting the output of the return current $I_R$.

In order to reduce the frequency of the request for the return current $I_R$ in the system of this embodiment, it is advantageous to set a long period of time for maintaining the instruction current $I_{op}$. However, a reduced period of time for maintaining the instruction current $I_{op}$ is preferable in order to accurately maintain a minimum amount of the instruction current $I_{op}$, that is, in order to achieve a maximum reduction in the power consumption of the electromagnetically driven valve 10.

Normally the power consumption of the electromagnetically driven valve 10 increases with decreases in length of the operation cycle thereof, that is, with increases in the operating speed of the internal combustion engine. Therefore, the electromagnetically driven valve 10 is required to have such an excellent power economy characteristic that more power is saved with increases in the engine revolution speed NE. Consequently, it is desirable that the keep time of the instruction current $I_{op}$ be reduced with increases in the engine revolution speed. Considering this respect, the system of this embodiment is designed to change the keep time of the instruction current $I_{op}$ with changes in the engine revolution speed NE.

Figure 12:
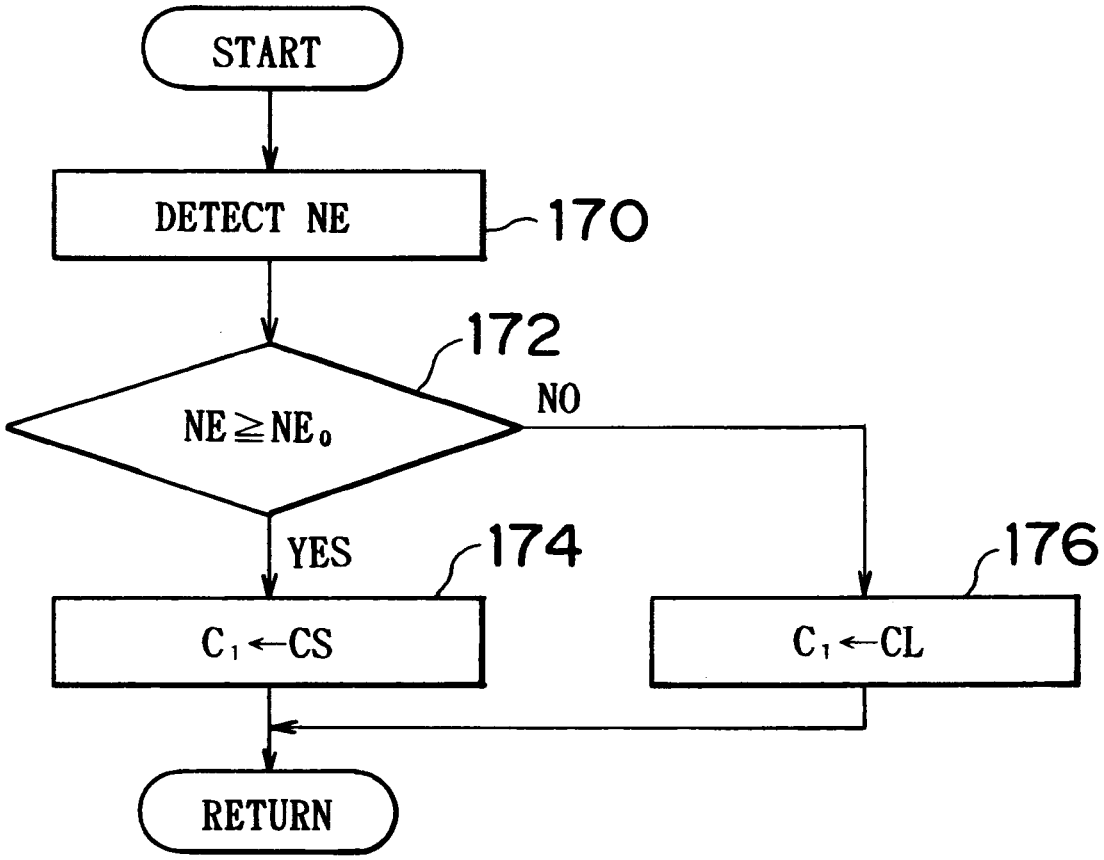
FIG. 12 is a flowchart illustrating a control routine executed to set a period during which the updated instruction current $I_{op}$ is maintained in the electromagnetically driven valve of the second embodiment.

FIG. 12 shows a flowchart of a control routine performed by the controller 44 in order to accomplish the aforementioned function. The routine illustrated in FIG. 12 is a periodical interrupt routine executed at predetermined intervals. When the routine is started, the processing of step 170 is first executed.

In step 170, the controller 44 detects an engine revolution speed NE.

Subsequently in step 172, it is determined whether the engine revolution speed NE is equal to or greater than a predetermined value $NE_0$. If $NE \geqq NE_0$ holds, it can be considered that the internal combustion engine is operating in a high speed range. In this case, operation proceeds to step 174. Conversely, if it is determined in step 172 that NE≧NEO does not hold, it can be considered that the internal combustion engine is operating in a low speed range. In this case, operation proceeds to step 176.

In step 174, the controller 44 substitutes a short period predetermined value CS for the predetermined value C1 (see step 164), which is compared with the count of the keep counter CKEEP. After step 174, the present cycle of the routine ends.

On the other hand, in step 176, the controller 44 substitutes a long period predetermined value CL that is longer than the short period predetermined value CS, for the predetermined value C1, which is compared with the count of the keep counter CKEEP as described above. After step 176, the present cycle of the routine ends.

Through the operation described above, the keep time of the instruction current $I_{op}$ can be appropriately changed in accordance with the engine revolution speed NE. Therefore, the system of this embodiment can achieve an appropriate power economy characteristic and appropriate operation stability in accordance with the operating conditions of the internal combustion engine.

A third embodiment of the invention will be described with reference to FIGS. 13A through 13C and FIGS. 14 and 15.

Figures 13A, 13B, 13C:
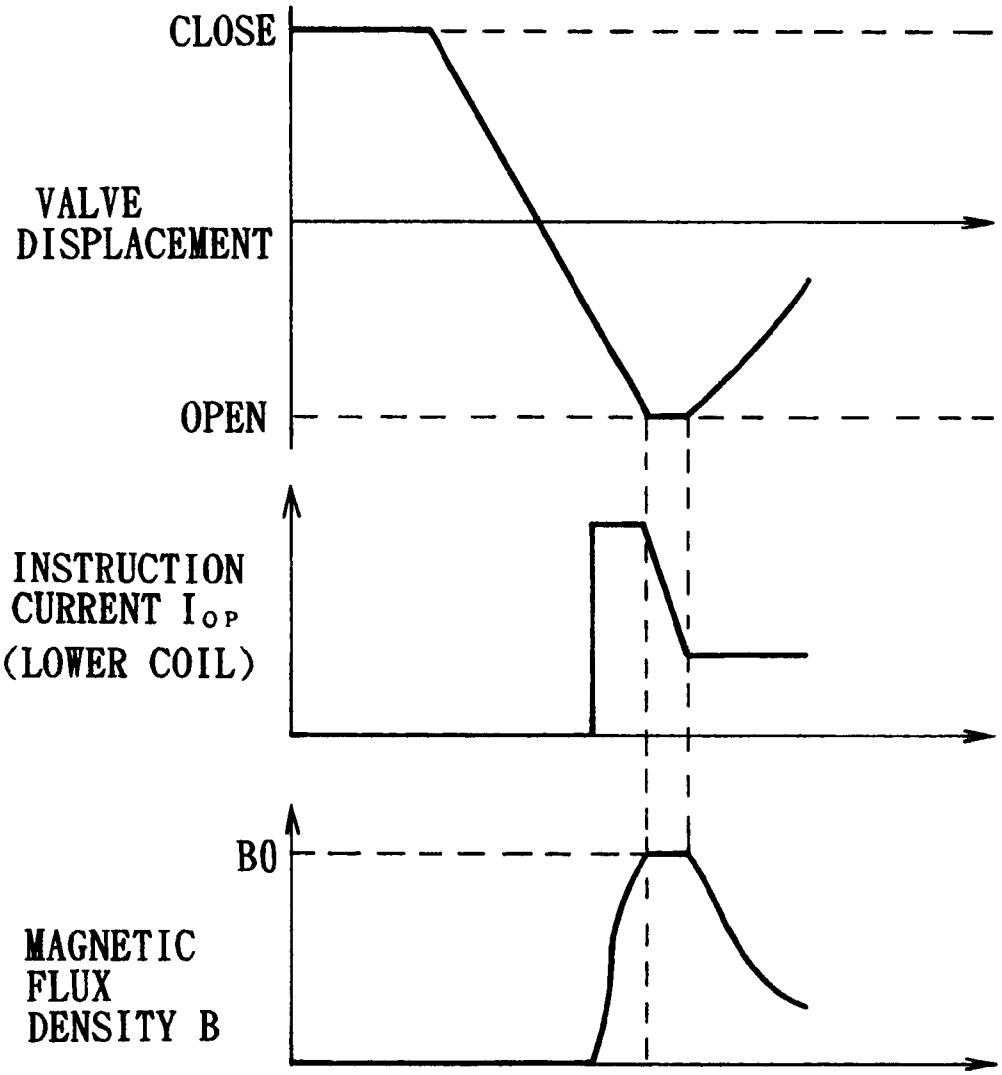
FIG. 13A is a time chart indicating the displacement of the valve in an electromagnetically driven valve of the third embodiment, where the step out occurs.
FIG. 13B is a time chart indicating the instruction current $I_{op}$ to the lower coil in the electromagnetically driven valve of the third embodiment.
FIG. 13C is a time chart indicating changes of the magnetic flux density occurring in an lower magnet when the step out occurs in the electromagnetically driven valve of the third embodiment.

FIG. 13A shows a time chart indicating displacement of the valve 12. FIG. 13B indicates a basic waveform of the instruction current $I_{op}$ supplied to the lower coil 34. FIG. 13C indicates changes in the magnetic flux density B produced between the lower coil 34 and the armature 22.

FIG. 13A indicates an operation of the valve 12 where the valve 12 reaches the open valve end, and then moves from the open valve end toward the closed valve end, that is, where the valve 12 steps out. Increased magnetic flux is more likely to occur between the lower coil 34 and the armature 22 as the distance therebetween decreases. Therefore, if the valve 12 steps out after the instruction current $I_{op}$ is kept at the holding current $I_H$, the magnetic flux density B exhibits a decreasing tendency as indicated in FIG. 13C.

However, if the valve 12 is properly held at the open valve end, the magnetic flux density B is held at a predetermined value corresponding to the holding current $I_H$ after the instruction current $I_{op}$ has been controlled to the holding current $I_H$. Therefore, the system of this embodiment is able to precisely determine whether the valve 12 is properly operating or has stepped out, by determining whether a proper magnetic flux density B is produced after the instruction current $I_{op}$ has been controlled to the holding current $I_H$.

Figure 14:
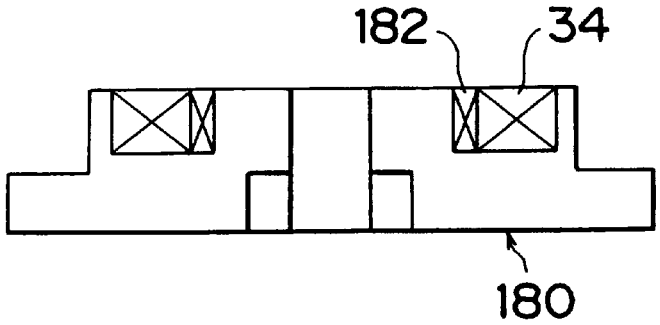
FIG. 14 is a sectional view of the lower coil used in the electromagnetically driven valve of the third embodiment.

The system of this embodiment can be realized by modifying the system construction illustrated in FIG. 1 in the following manner. That is, the lower electromagnet 26 is replaced with a lower electromagnet 180, and the upper electromagnet 24 is replaced with an upper electromagnet that has substantially the same construction as the lower electromagnet 180. FIG. 14 shows a sectional view of the lower electromagnet 180 used in the system of this embodiment. Elements and portions comparable to those shown in FIG. 1 are represented by comparable reference numerals in FIG. 14, and will not be described again.

As shown in FIG. 14, the lower electromagnet 180 has an annular search coil 182 that is disposed radially inward of the lower coil 34. In this construction, the magnetic flux around the lower coil 34 extends through the interior of the search coil 182. Therefore, by using the search coil 182, it becomes possible to detect the magnetic flux Φ extending inside the search coil 182, that is, the magnetic flux Φ produced by the lower electromagnet 180.

The search coil 182 is connected to the controller 44 shown in FIG. 1. Therefore, the controller 44 can detect the magnetic flux Φ produced by the lower electromagnet 180. The magnetic flux density B can be determined by dividing the magnetic flux Φ by the area S of the opening of the search coil 182. Thus, the controller 44 is able to detect the magnetic flux Φ produced by the lower electromagnet 180 and the magnetic flux density B thereof.

Figure 15:
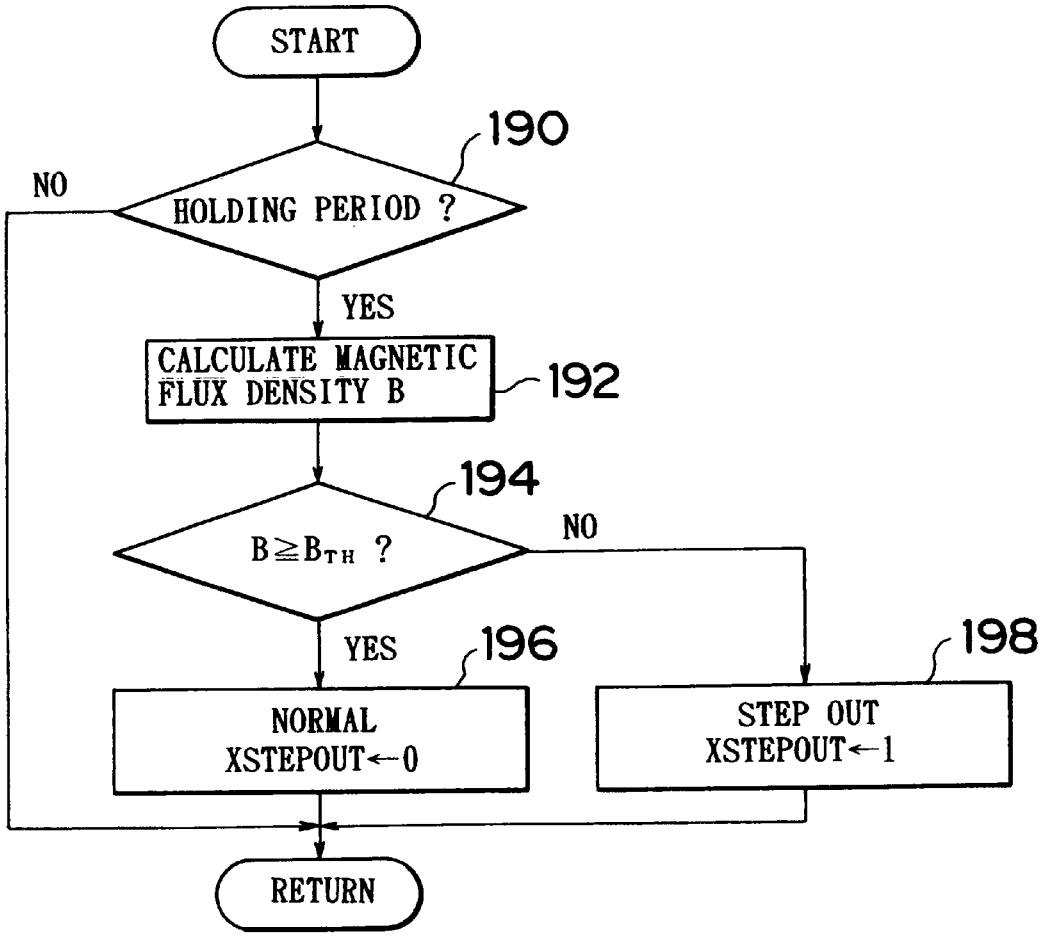
FIG. 15 is a flowchart illustrating a control routine executed to detect the step out of the valve in the electromagnetically driven valve of the third embodiment.

FIG. 15 shows a flowchart of a control routine executed by the controller 44 to detect the step out of the valve 12. That is, the routine realizes a step out detecting device. The routine illustrated in FIG. 15 is executed to determine whether the valve 12 has stepped out, on the basis of the magnetic flux density B extending through the armature 22. This routine is a periodic interrupt routine executed at predetermined time intervals. When the routine is started, the processing of step 190 is first executed.

In step 190, the controller 44 determines whether it is during a valve holding period, that is, a period during which the valve 12 needs to be held at the open valve end or the closed valve end. If it is determined that it is not during the valve holding period, the present cycle of the routine immediately ends without any further processing. Conversely, if it is determined that it is during the valve holding period, operation proceeds to step 192.

In step 192, the controller 44 detects a density B of the magnetic flux through the armature 22 based on the output from the search coil 182 disposed inside the upper electromagnet or the lower electromagnet 180.

Subsequently in step 194, it is determined whether the magnetic flux density B is equal to or greater than a predetermined value $B_{TH}$. If $B \geqq B_{TH}$ holds, it can be considered that the valve 12 is properly held at either displacement end. In this case, operation proceeds to step 196. Conversely, if $B \geqq B_{TH}$ does not hold, it can be considered that the valve 12 has stepped out. In this case, operation proceeds to step 198.

In step 196, the controller 44 resets the step-out flag XSTEPOUT to "0" to indicate that the valve 12 is normally operating. After this operation, the controller 44 performs operations for reducing the power consumption (see FIGS. 5, 10 and 11) while normally operating the valve 12. The present cycle of the routine ends after step 196.

In step 198, on the other hand, the controller 44 sets the step-out flag XSTEPOUT to "1" to indicate that the valve 12 has stepped out. After this operation, the controller 44 performs operations to return the valve 12 to a normal state (see FIGS. 5, 10 and 11). The present cycle of the routine ends after step 198.

In the manner described above, the system of this embodiment is able to precisely detect the step out of the valve 12 on the basis of the magnetic flux density B through the armature 22. Therefore, the system of this embodiment is able to precisely perform proper control in accordance with the condition of the valve 12.

Although in the foregoing embodiment, it is determined whether the operation of the valve 12 is normal on the basis of whether the magnetic flux density B is equal to or greater than the predetermined value $B_{TH}$, the present invention is not restricted by this manner of determination. For example, it is also possible to determine whether the operation of the valve 12 is normal on the basis of the magnetic flux Φ is equal to or greater than a threshold.

During the valve holding period in the system of this embodiment, the deferential dB/dt of the magnetic flux density B becomes negative only in the case where the valve 12 has stepped out. Therefore, it is also possible to determined whether the operation of the valve 12 is normal, on the basis of whether $dB/dt \geqq 0$ holds.

Furthermore, in the system of this embodiment, the electromagnetic force Fem that acts between the armature 22 and the upper or lower electromagnet can be expressed as $Fem=B^2 \cdot S/\mu_0$ where B is magnetic flux density, and S is a sectional area of the upper or lower core, and $\mu_0$ is the magnetic permeability of air. If the valve 12 steps out, the electromagnetic force Fem becomes a small value in comparison with the value thereof when the valve 12 is properly held at either displacement end. Therefore, the controller 44 can also determine whether the operation of the valve 12 is proper on the basis of whether the electromagnetic force Fem is equal to or greater than a predetermined threshold $Fem_0$.

Further, the motion of the valve 12 in the system of this embodiment can be expressed by the following equation of motion:

$$M \cdot d^2X/dt^2 = K \cdot X + Ck \cdot dX/dt + f + Fem + F$$

where M is the mass of the valve 12 and the like; X is the position of the valve 12; K is spring constant; Ck is friction coefficient; f is friction constant; and F is external disturbance including combustion pressure and the like. In this equation, M, K, Ck and f can be handled as fixed values. Therefore, if external disturbance, such as F and the like, is detected, the position X of the valve 12 can be determined by solving the equation. According to the invention, it is also possible for the controller 44 to determines the position X in this manner and determine whether the operation of the valve 12 is normal, by comparing the position X with a target position of the valve 12.

Although in the foregoing embodiment, the magnetic flux Φ and the magnetic flux density B are detected by using the search coil 182, this detecting method does not limit the method for detecting the magnetic flux Φ and the magnetic flux density B according to the invention. For example, it is also possible to detect the magnetic flux Φ and the like on the basis of the voltage V between the ends of the upper coil 30 or the lower coil 34, and the exciting current I therethrough.

That is, when an exciting current I flows through the lower coil 34 during operation of the electromagnetically driven valve 10, the following equation holds between the voltage V between the ends of the lower coil 34 and the exciting current I therethrough.

$$V = R \cdot I + N \cdot d\Phi/dt$$

where R is the electric resistance of the lower coil 34; and N is the number of turns of the lower coil 34. From this relational equation, the magnetic flux Φ can be expressed as in:

The end-to-end voltage V and the exciting current I can easily be detected in a system as shown in FIG. 1. Therefore, the magnetic flux Φ can also be easily detected on the basis of the end-to-end voltage V and the exciting current I, without using the search coil 182. The magnetic flux density B can be determined by dividing the magnetic flux Φ by the sectional area S of the upper core 28 or the lower core 32. Therefore, the method wherein the occurrence of step out is determined on the basis of the magnetic flux density B and the like can also be used in a system that does not have the search coil 182.

Figure 16:
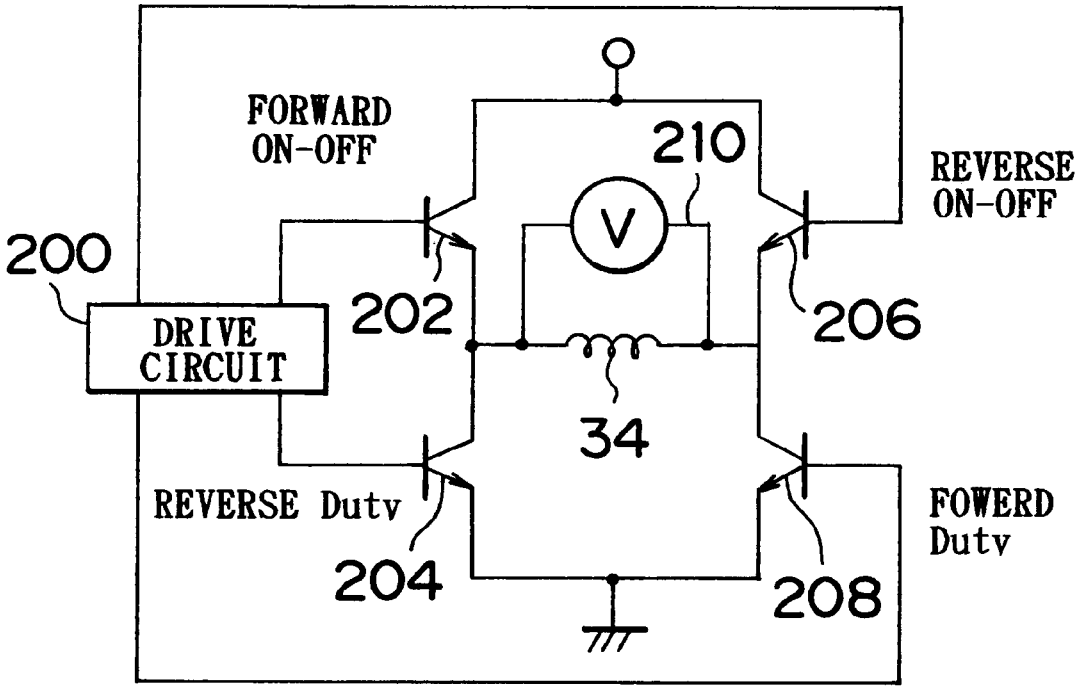
FIG. 16 is a diagram of a circuit provided corresponding to the lower coil in the system according to the fourth to sixth embodiments.

A fourth embodiment of the invention will be described with reference to FIGS. 16 through 19. FIG. 16 shows a circuit provided in the drive device 46 shown in FIG. 1. The circuit shown in FIG. 16 is used to drive the lower coil 34. In addition to the circuit shown in FIG. 16, the drive device 46 also has a similar circuit for driving the upper coil 30.

The circuit shown in FIG. 16 has a drive circuit 200. The drive circuit 200 is connected to the base terminals of first to fourth transistors 202, 204, 206, 208. The collector terminals of the first and third transistors 202, 206 are connected to a source voltage. The emitter terminals of the first and third transistors 202, 206 are respectively connected to the two ends of the lower coil 34.

A voltmeter 210 is connected to the two ends the lower coil 34. The collector terminals of the second and fourth transistors 204, 208 are respectively connected to the two ends of the lower coil 34. The emitter terminals of the second and fourth transistors 204, 208 are grounded.

In the circuit shown in FIG. 16, the first and forth transistors 202, 208 are used to apply voltage to the lower coil 34 in a forward direction, that is, the direction from left to right in FIG. 16, thus forming a forward switch circuit. The second and third transistors 204, 206 are used to apply voltage to the lower coil 34 in the reverse direction, that is, the direction from right to left in FIG. 16, thus forming a reverse switch circuit. Moreover, the first and third transistors 202, 206 are used as devices that are on-off-controlled so as to set a voltage applying direction. The second and fourth transistors 204, 208 are used as devices that are duty-controlled so as to control the exciting current I. The drive circuit 200 controls a switch circuit formed of the first to fourth transistors.

When the exciting current I in the forward direction is needed, the drive circuit 200 turns on the first transistor 202, and appropriately duty-drives the fourth transistor 208. When the forward exciting current I needs to be reduced, or when the exciting current I in the reverse direction is needed, the drive circuit 200 turns on the third transistor 206, and appropriately duty-controls the second transistor 204. With this circuit, it becomes possible to control the exciting current I with high precision by promptly applying voltage to the lower coil 34 in the forward and reverse directions.

FIGS. 17A through 17E show time charts indicating various factors that change with proper displacement of the valve 12 from the closed valve end to the open valve end. More specifically, the time charts of FIGS. 17A through 17E indicate the displacement or position of the valve 12, the instruction current $I_{op}$, the magnetic flux Φ produced by the lower coil 34, changes dΦ/dt in the magnetic flux 101 , and the voltage between the two terminals of the lower coil 34, respectively.

Figures 17A, 17B, 17C, 17D, 17E:
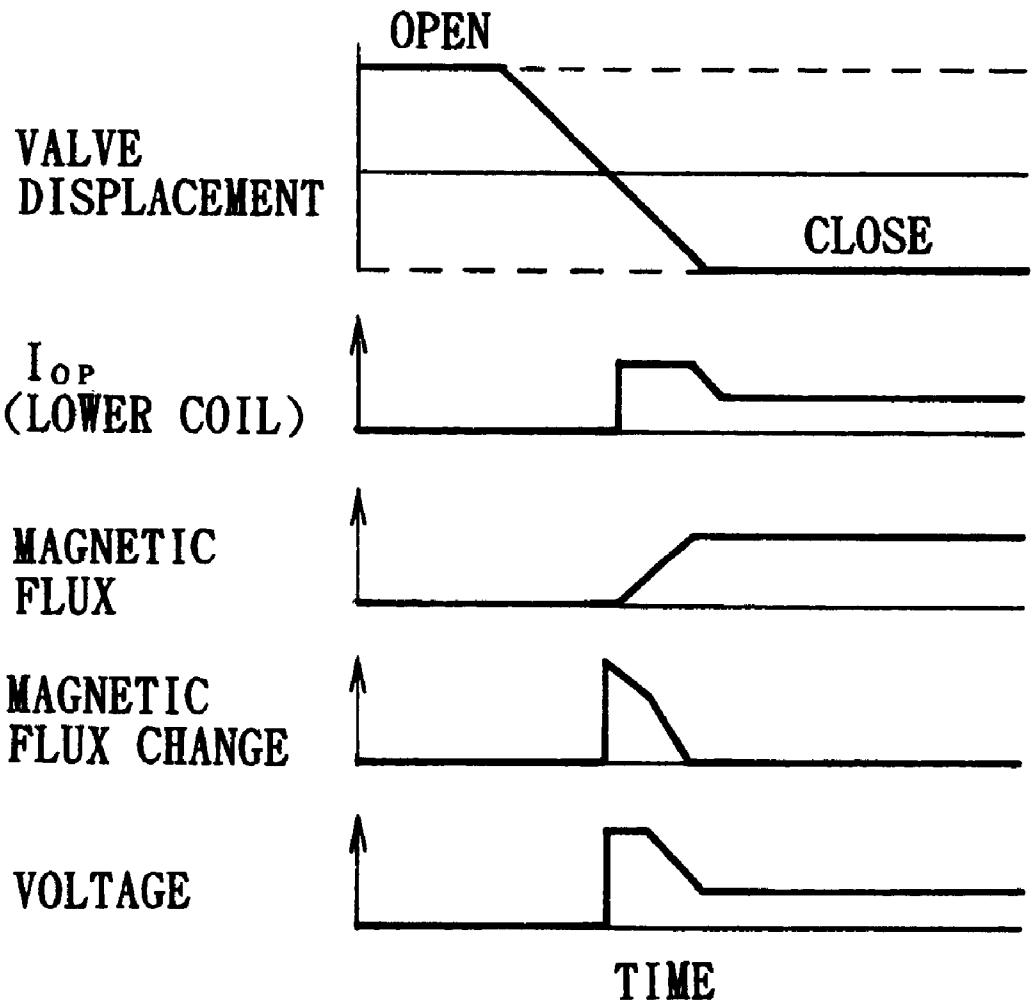
FIG. 17A is a time chart indicating the displacement of the valve, where the electromagnetically driven valve of the fourth embodiment normally operates.
FIG. 17B is a time chart indicating the instruction current $I_{op}$ to the lower coil in the electromagnetically driven valve of the fourth embodiment.
FIG. 17C is a time chart indicating the magnetic flux of the lower electromagnet, where the electromagnetically driven valve of the fourth embodiment normally operates.
FIG. 17D is a time chart indicating the changing rate of the magnetic flux of the lower electromagnet, where the electromagnetically driven valve of the fourth embodiment normally operates.
FIG. 17E is a time chart indicating the voltage between the two terminals of the lower coil, where the electromagnetically driven valve of the fourth embodiment normally operates.
Figures 18A, 18B, 18C, 18D, 18E:
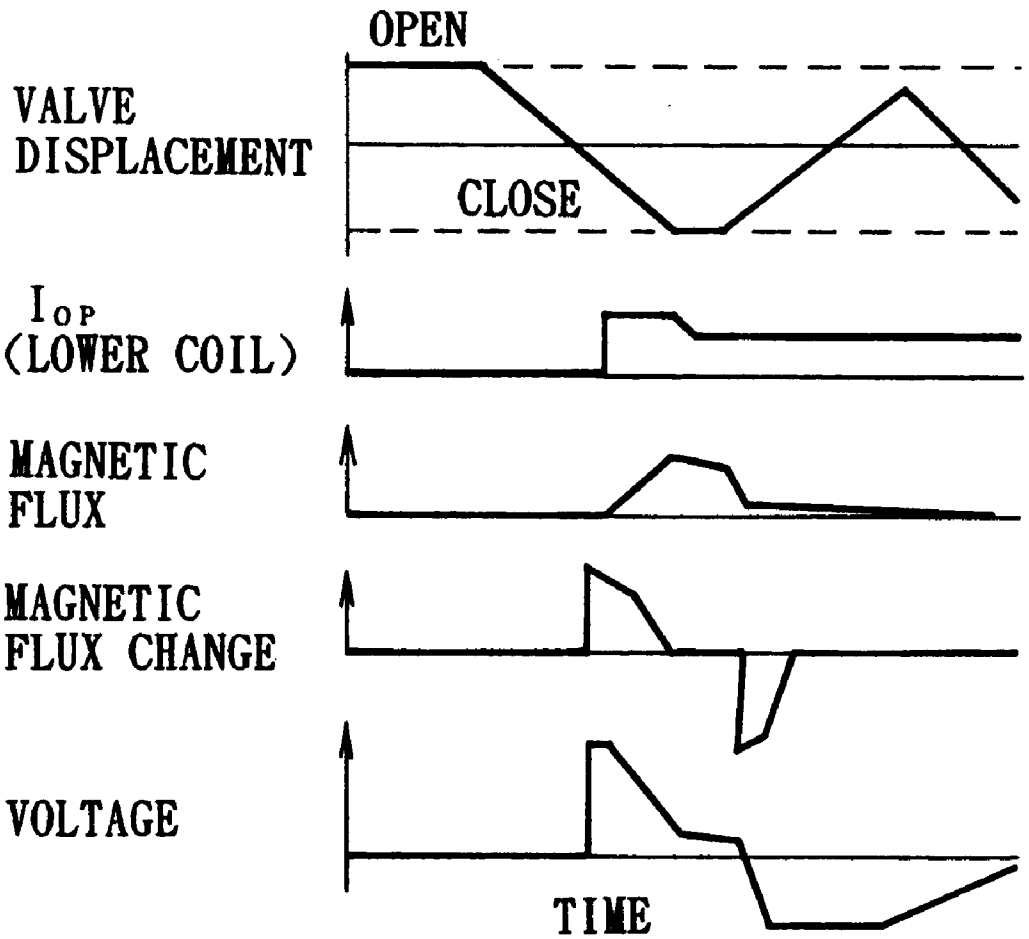
FIG. 18A is a time chart indicating the displacement of the valve, where the electromagnetically driven valve of the fourth embodiment steps out.
FIG. 18B is a time chart indicating the instruction current $I_{op}$ to the lower coil in the electromagnetically driven valve of the fourth embodiment.
FIG. 18C is a time chart indicating the magnetic flux of the lower electromagnet, where the electromagnetically driven valve of the fourth embodiment steps out.
FIG. 18D is a time chart indicating the changing rate of the magnetic flux of the lower electromagnet, where the electromagnetically driven valve of the fourth embodiment steps out.
FIG. 18E is a time chart indicating the voltage between the two terminals of the lower coil, where the electromagnetically driven valve of the fourth embodiment steps out.

As indicated in FIG. 17B, the instruction current $I_{op}$ changes from "0" to the attracting current $I_A$ during the displacement of the valve 12 from the closed valve end to the open valve end. Approximately synchronously with the arrival of the valve 12 at the open valve end, the instruction current $I_{op}$ is reduced to the holding current $I_H$. The drive circuit 200 shown in FIG. 16 suitably controls the first to fourth transistors 202, 204, 206, 208 so that the exciting current I through the lower coil 34 becomes equal to the instruction current $I_{op}$. As a result, the exciting current I exhibits changes following the changes in the instruction current $I_{op}$.

When the valve 12 operates properly, the magnetic flux Φ is increased during approach of the valve 12 to the open valve end, and maintained at a fixed value after the arrival of the valve 12 at the open valve end, as indicated in FIG. 17C. During such proper operation of the valve 12, the changing rate dΦ/dt of the magnetic flux Φ always remains at or above "0", as indicated in FIG. 17D.

While the changing rate dΦ/dt of the magnetic flux Φ is positive (>0), the lower coil 34 produces a reverse electromotive force −N·dΦ/dt in such a direction as to hinder an increase in the exciting current I. The drive circuit 200 drives the first and fourth transistors 202, 208 so as to apply to the two ends of the lower coil 34 a voltage V that can cancel the reverse electromotive force −N·dΦ/dt and cause the exciting current I to flow in the forward direction, that is, the direction of the instruction current $I_{op}$. The voltage V applied to the ends of the lower coil 34 can be expressed as:

$$V=R\cdot I+N\cdot d\Phi/dt$$

where R is the electric resistance of the lower coil 34; I is the exciting current that needs to flow through the lower coil 34; and N is the number of turns of the lower coil 34.

The changing rate dΦ/dt of the magnetic flux Φ always remains at or above "0" if the valve 12 properly operates (more precisely, if the instruction current $I_{op}$ is zero or positive), as described above. Therefore, under this condition, the voltage V between the two terminals of the lower coil 34 always remains equal to or higher than R·I.

FIGS. 18A through 18E show time charts indicating changes in the various factors that occur with the displacement of the valve 12 in a case where the valve 12 steps out during the holding period following the arrival of the valve 12 at the open valve end. The time charts of FIGS. 18A through 18E indicate the displacement or position of the valve 12, the instruction current $I_{op}$, the magnetic flux Φ produced by the lower coil 34, changes dΦ/dt of the magnetic flux Φ, and the voltage between the two terminals of the lower coil 34, respectively.

If the valve 12 steps out during the valve opening period, the magnetic flux Φ changes at a negative changing rate −dΦ/dt (FIG. 18D) due to the armature 22 moving away from the lower electromagnet 26. While the changing rate dΦ/dt of the magnetic flux Φ is negative (<0), the lower coil 34 produces a reverse electromotive force −N·dΦ/dt in such a direction as to hinder a decrease in the exciting current I, that is, in such a direction as to cause the exciting current I to flow in the forward direction. The drive circuit 200 drives the first to fourth transistors 202, 204, 206, 208 so that the voltage V between the two terminals of the lower coil 34 becomes a voltage that can cancel the reverse electromotive force −N·dΦ/dt.

The voltage V applied between the two terminals of the lower coil 34 in this situation is set to the value V=R·I+N·dΦ/dt (dΦ/dt≦0), which is smaller than the multiplication product R·I of the electric resistance R of the lower coil 34 and the exciting current I that needs to be supplied through the lower coil 34. In this manner, the system of this embodiment sets the voltage between the two terminals of the lower coil 34 to the value smaller than the multiplication product R·I only in the case where the valve 12 steps out, under the condition that the instruction current $I_{op}$ is equal to or greater than zero.

The exciting current I that needs to flow through the lower coil 34 or the upper coil 30 during operation of the electromagnetically driven valve 10 may be pre-stored as a predetermined pattern. Therefore, the controller 44 can always read a proper multiplication product R·I from the memory during operation of the electromagnetically driven valve 10. Consequently, the system of this embodiment is able to precisely determine whether the step out of the valve 12 is occurring, by comparing the multiplication product R·I and the voltage V between the two terminals of the lower coil 34. The system of this embodiment is characterized in that this method is used to detect the step out of the valve 12.

Figure 19:
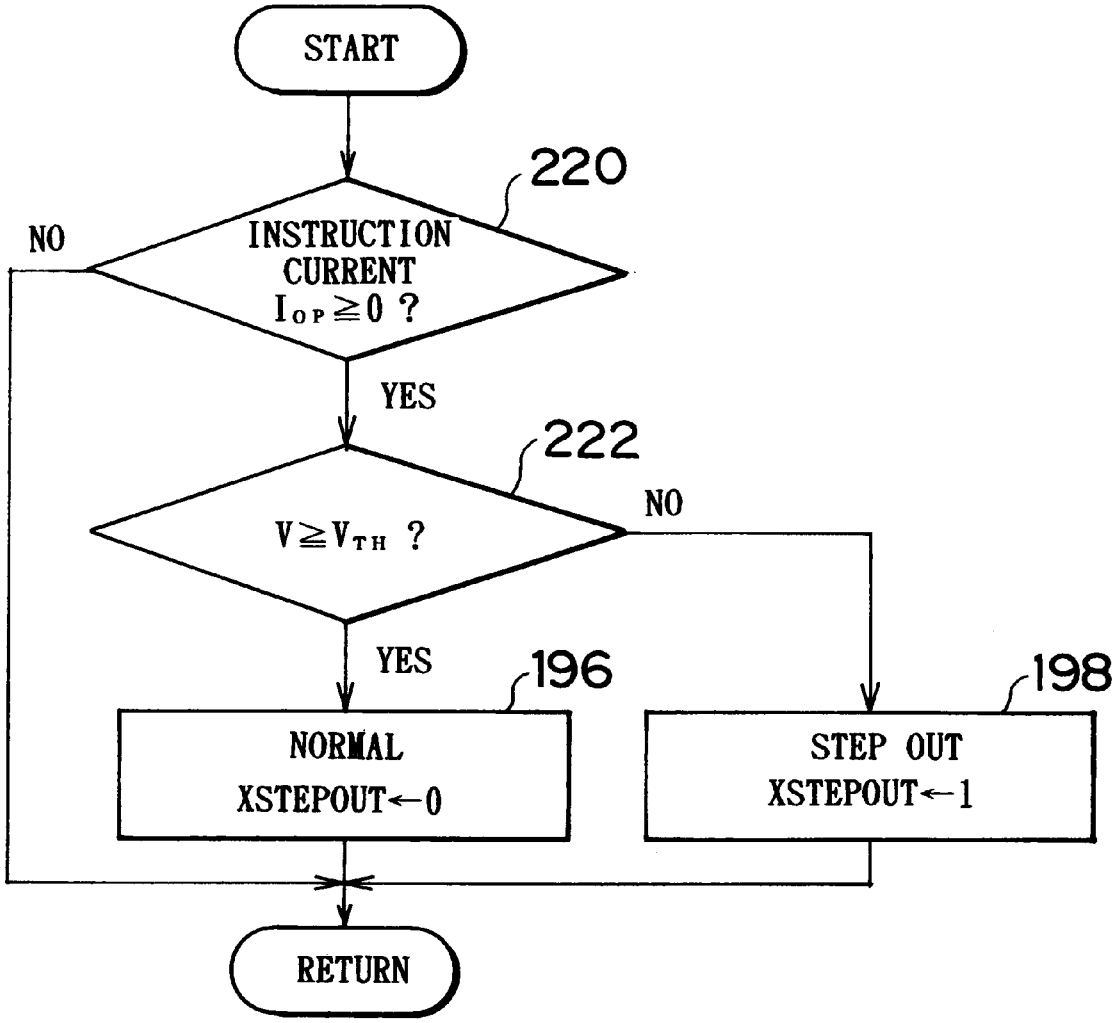
FIG. 19 is a flowchart illustrating a control routine executed to detect the step out of the valve in the electromagnetically driven valve of the fourth embodiment.

FIG. 19 shows a flowchart of a control routine executed by the controller 44 to accomplish the aforementioned characteristic function. This routine functions as a step out detecting device. The routine illustrated in FIG. 19 is a periodic interrupt routine executed repeatedly at predetermined time intervals. Steps comparable to those in FIG. 15 are represented by comparable reference numerals in FIG. 19, and will not be described again. When the routine illustrated in FIG. 19 is started, the processing of step 220 is first executed.

In step 220, it is determined whether the instruction current $I_{op}$ is equal to or greater than 0. If $I_{op}$>0 does not hold, the magnetic flux Φ may change at a negative changing rate even if the valve 12 operates normally. Therefore, under this circumstance, the voltage V smaller than the multiplication product R·I may occur between the two terminals of the upper coil 30 or the lower coil 34 even if the valve 12 operates normally. Consequently, if it is determined that $I_{op} \geqq 0$ does not hold, the present cycle of the routine ends without performing further operation for detecting the step out. Conversely, if it is determined in step 220 that the condition $I_{op} > 0$ is met, operation proceeds to step 222.

In step 222, it is determined whether the voltage V between the two terminals of the upper coil 30 or the lower coil 34 is equal to or higher than a predetermined threshold $V_{TH}$. The predetermined threshold $V_{TH}$ is a value that is set on the basis of the multiplication product R·I, more specifically, a value that is slightly smaller than the multiplication product R·I. Therefore, if it is determined that $V \geqq V_{TH}$ holds, it can be considered that the step out of the valve 12 is not occurring. In this case, the processing the same as in step 196 in FIG. 15 is executed, followed by the end of the present cycle of the routine. Conversely, if the condition $V \geqq V_{TH}$ is not met, it can be considered that the valve 12 has stepped out. In this case, the processing the same as in step 198 in FIG. 15 is executed, followed by the end of the present cycle of the routine.

In this manner, the system of this embodiment is able to precisely detect the step out of the valve 12 on the basis of the voltage v between the two terminals of the upper coil 30 or the lower coil 34. Therefore, the system of this embodiment is able to precisely perform proper control in accordance with the condition of the valve 12.

A fifth embodiment of the invention will be described with reference to FIG. 20.

A system according to this embodiment may be realized by employing a system construction as in the fourth embodiment. In the system of the fifth embodiment, the controller 44 performs a routine illustrated in FIG. 20, instead of the routine illustrated in FIG. 19.

The system of this embodiment has a circuit as shown in FIG. 16. That is, the circuit has first and fourth transistors 202, 208 for applying voltage to the lower coil 34 in the forward direction, and second and third transistors 204, 206 for applying voltage to the lower coil 34 in the reverse direction.

When the valve 12 operates normally, the application of reverse voltage is requested only in a case where the exciting current I needs to be reduced. Therefore, when the valve 12 operates normally, the second and third transistors 204, 206 always remain off while the instruction current $I_{op}$ is being increased or maintained. Conversely, if the valve 12 has stepped out, the second and third transistors 204, 206 may be turned to cancel the reverse electromotive force produced by the lower coil 34, even when the instruction current $I_{op}$ is being increased or maintained.

That is, while the instruction current $I_{op}$ is being increased or maintained, the second and third transistors 204, 206 are turned on only in a case where the valve 12 has stepped out. Therefore, the system of this embodiment is able to determine that the valve 12 has stepped out, if the second and third transistors 204, 206 are turned on while the instruction current $I_{op}$ is being increased or maintained. Employment of this method to determine the valve 12 has stepped out is a characteristic of the system of this embodiment.

Figure 20:
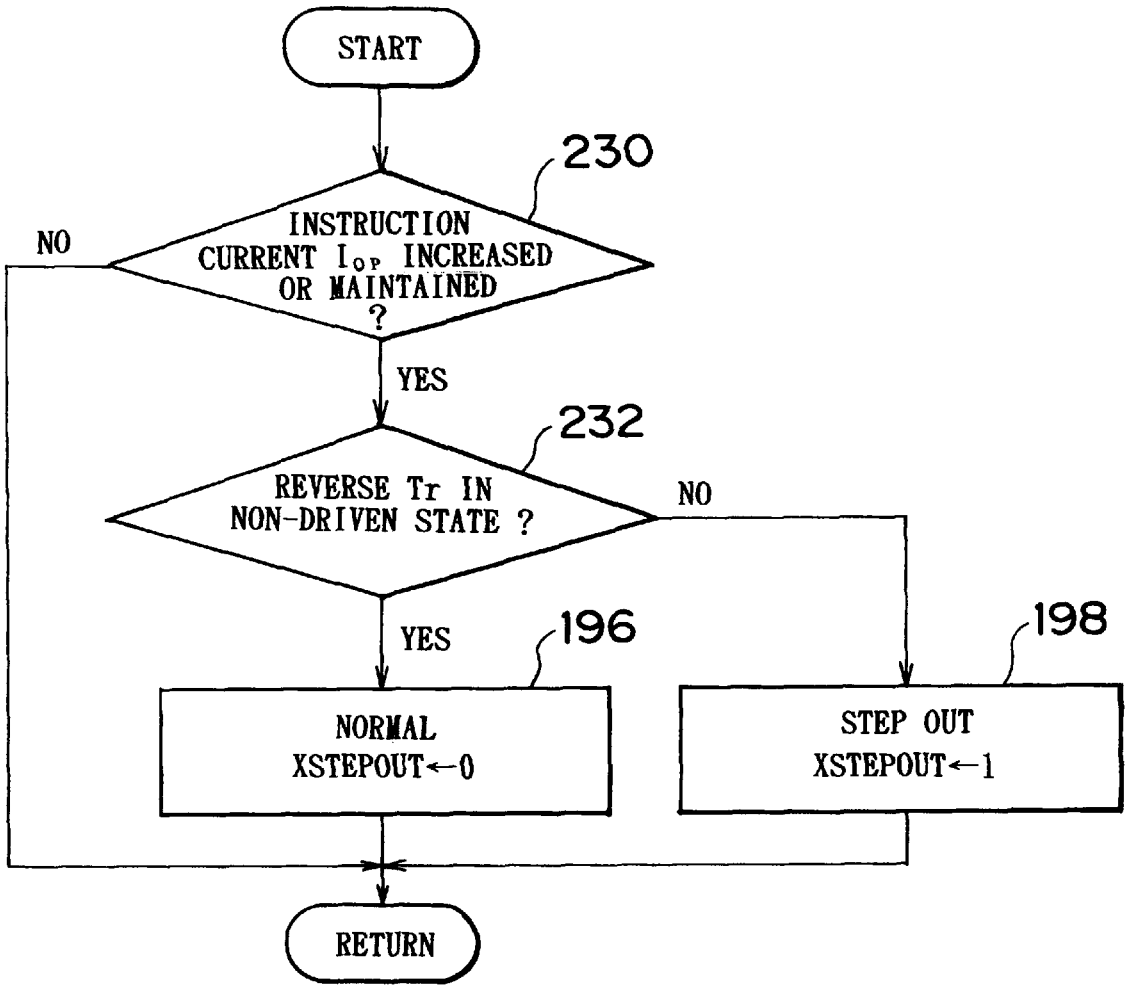
FIG. 20 is a flowchart illustrating a control routine executed to detect the step out of the valve in the electromagnetically driven valve of the fifth embodiment.

FIG. 20 shows a flowchart of a control routine executed by the controller 44 to accomplish the aforementioned characteristic function. The routine realizes a step out detecting device. The routine illustrated in FIG. 20 is a periodic interrupt routine executed repeatedly at predetermined time intervals. Steps comparable to those shown in FIGS. 15 or 19 are represented by comparable reference numerals in FIG. 20, and will not be described again. When the routine illustrated in FIG. 20 is started, the processing of step 230 is first executed.

In step 230, it is determined whether the instruction current $I_{op}$ is being increased or maintained. If the instruction current $I_{op}$ is not being increased nor maintained, the present cycle of the routine ends without performing further operation for detecting the step out. Conversely, if it is determined in step 230 that the instruction current $I_{op}$ is being increased or maintained, operation proceeds to step 232.

In step 232, it is determined whether the second and third transistors 204, 206 are both in a non-driven state. If it is determined that these reverse-direction transistors are in the non-driven state, it can be considered that the valve 12 has not stepped out. In this case, the processing of step 196 is subsequently executed, followed by the end of the present cycle of the routine. Conversely, if it is determined that the second or third transistor 204, 206 is driven, it can be considered that the valve 12 has stepped out. In this case, the processing of step 198 is subsequently performed, followed by the end of the present cycle of the routine.

The system of this embodiment is able to precisely detect the step out of the valve 12 on the basis of the operating state of the second and third transistors 204, 206 as described above. Therefore, the system of this embodiment is able to precisely perform proper control in accordance with the condition of the valve 12.

A sixth embodiment of the invention will be described with reference to FIGS. 21 through 24. A system according to this embodiment is realized by modifying the system construction as shown in FIG. 1, that is, providing a circuit as shown in FIG. 16 in the drive device 46. In this system, the controller 44 executes a routine illustrated in FIG. 24.

In the fourth embodiment, the controller 44 detects the step out of the valve 12 by utilizing the fact that if the valve 12 steps out, the voltage V between the two terminals of the upper coil 30 or the lower coil 34 becomes a small value in comparison with the normal value. In the fifth embodiment, the controller 44 detects the step out of the valve 12 by utilizing the fact that the second and third transistors 204, 206 are turned on only when the valve 12 steps out.

The phenomenon in which the voltage V between the two terminals of the upper coil 30 or the lower coil 34 becomes lower than the normal value when the valve 12 steps out, and the phenomenon in which the second and third transistors 204, 206 are turned on at the time of the step out of the valve 12 are caused in the following manner. That is, after the step out of the valve 12, the magnetic flux Φ changes so that the upper coil 30 or the lower coil 34 produces a reverse electromotive force in such a direction as to hinder a decrease in the magnetic flux Φ. Therefore, the methods according to the fourth and fifth embodiments are unable to detect the step out of the valve 12 after the armature 22 has moved greatly apart from the displacement end, subsequently to the step out of the valve 12, and the change in the magnetic flux Φ has converged to a small value.

Immediately after the step out of the valve 12 is detected, the controller 44 outputs the return current $I_R$ so as to return the valve 12 to the normal state (see step 122 and FIGS. 8A and 8B). At the time of the request for the output of the return current $I_R$, the change in the magnetic flux Φ is great. Therefore, at such timing, the methods according to the fourth and fifth embodiment can precisely detect the step out of the valve 12.

However, if the valve 12 is not returned to the normal state despite the output of the return current $I_R$, the situation occurs where the valve 12 becomes far apart from the displacement end and the change in the magnetic flux Φ converges to a small value. The change in the magnetic flux Φ also converges to a small value in a case where the valve is returned to the normal state by the output of the return current $I_R$. Therefore, the methods according to the fourth and fifth embodiments may be unable to precisely detect whether the valve 12 has been returned to the normal state by the output of the return current $I_R$.

The system in the sixth embodiment is characterized in that if the step out of the valve 12 is detected at an open valve side or a closed valve side, the system performs control so as to displace the valve 12 toward the closed valve end or the open valve end, and determines whether the valve 12 is operating normally or whether the valve 12 is undergoing step out, on the basis of the voltage between the two terminals of the upper coil 30 or the lower coil 34.

Figures 21A, 21B, 21C:
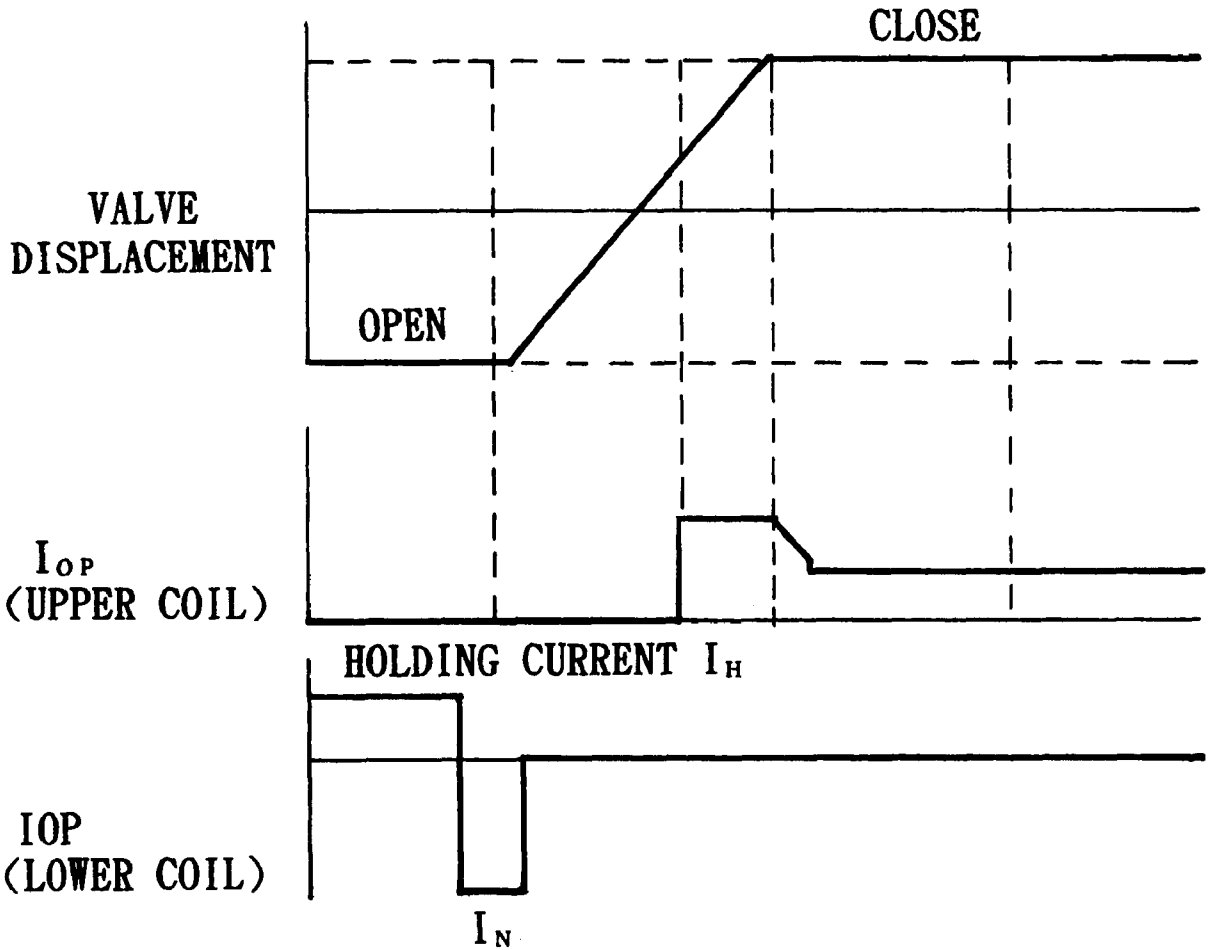
FIG. 21A is a time chart indicating the displacement of the valve in the electromagnetically driven valve of the sixth embodiment.
FIG. 21B is a time chart indicating the instruction current $I_{op}$ to the upper coil in the electromagnetically driven valve of the sixth embodiment.
FIG. 21C is a time chart indicating the instruction current $I_{op}$ to the lower coil in the electromagnetically driven valve of the sixth embodiment.

FIGS. 21A through 21C show time charts illustrating the operation of the system of this embodiment. The chart of FIG. 21A indicates the displacement of the valve 12 from the open valve end to the closed valve end. The charts of FIGS. 21B and 21C indicate the instruction current $I_{op}$ to the upper coil 30 and the instruction current $I_{op}$ to the lower coil 34, respectively.

During the holding period during which the valve 12 is held at the open valve end, the instruction current $I_{op}$ to the lower coil 34 is controlled to the holding current $I_H$ as indicated in FIG. 21C. During this period, an electromagnetic force is produced between the lower electromagnet 26 and the armature 22 so as to hold the valve 12 at the open valve end. I n order to quickly displace the valve 12 from the open valve end to the closed valve end upon the valve closing request, it is necessary to quickly eliminate the electromagnetic force acting between the lower electromagnet 26 and the armature 22.

In order to quickly eliminate the electromagnetic force acting between the lower electromagnet 26 and the armature 22, it is effective to apply a voltage to the lower coil 34 in the reverse direction upon the valve closing request so as to quickly di s continue the exciting current I through the lower coil 34. Therefore, in the system of this embodiment, the controller 44 controls the instruction current $I_{op}$ to a negative or reverse current $I_N$ for a predetermined period of time following the output of the valve closing request, as indicated in FIG. 21C. Similarly, if the valve opening request is outputted after the valve 12 has been held at the closed valve end, the controller 44 controls the instruction current $I_{op}$ to the upper coil 30 to the reverse current $I_N$ for a predetermined period of time. This operation of the embodiment quickly eliminates the residual magnetism regarding the armature 22 after the output of the valve opening or closing request, thereby achieving good responsiveness of the valve 12 in operation.

Figures 22A, 22B:
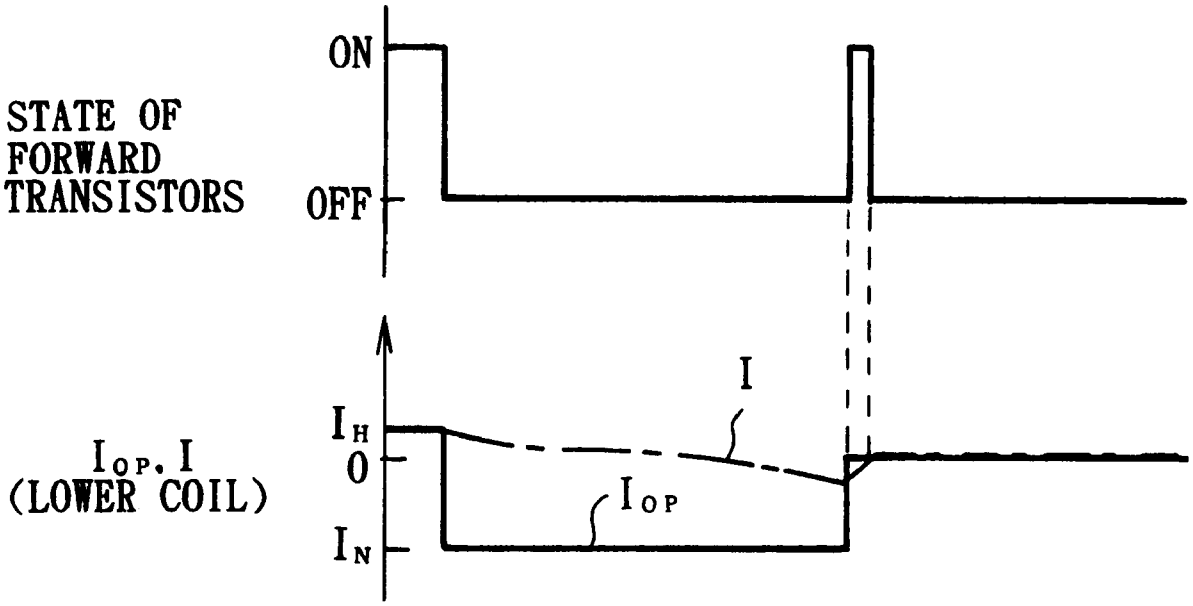
FIG. 22A is a time chart indicating the operation state of forward transistors, where the electromagnetically driven valve of the sixth embodiment normally operates.
FIG. 22B is a time chart indicating the instruction current $I_{op}$ and the exciting current I, where the electromagnetically driven valve of the sixth embodiment normally operates.
Figures 23A, 23B:
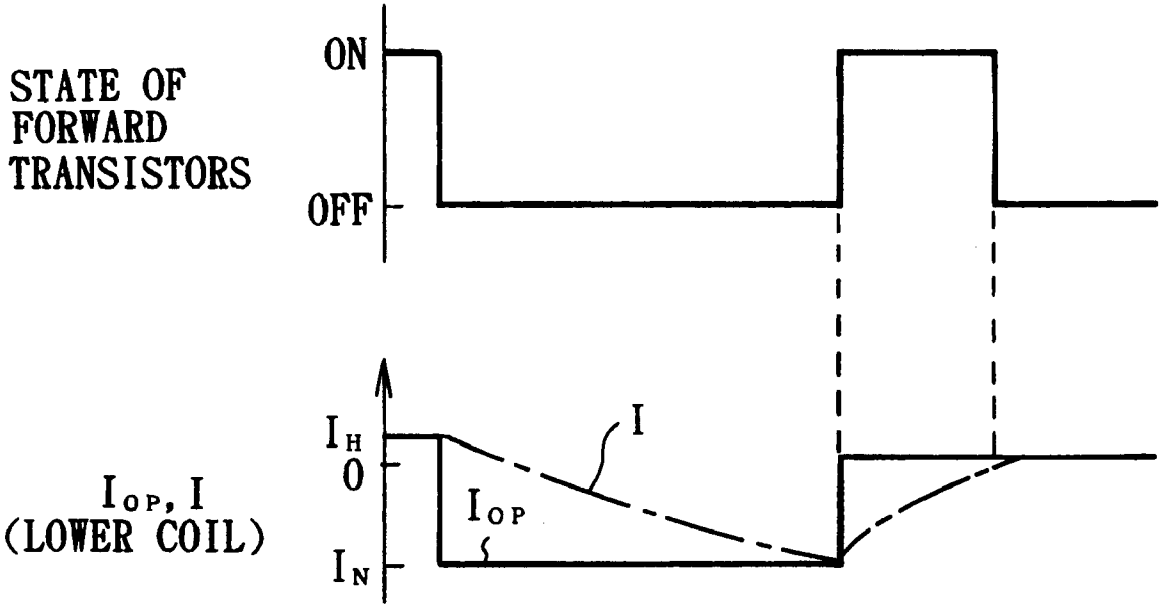
FIG. 23A is a time chart indicating the operation state of the forward transistors, where the step out has occurred in the electromagnetically driven valve of the sixth embodiment.
FIG. 23B is a time chart indicating the instruction current $I_{op}$ and the exciting current I where the step out has occurred in the electromagnetically driven valve of the sixth embodiment.

FIGS. 22A and 22B show time charts concerning the operation at the time of the valve closing request where the valve 12 is properly held at the open valve end before the valve closing request. FIGS. 23A and 23B show time charts concerning the operation at the time of valve closing request where the valve 12 is in the step out before the valve closing request. FIGS. 22A and 23A indicate the operation of the forward transistors, that is, the first and fourth transistors 202, 208 shown in FIG. 16. FIGS. 22B and 23B indicate the instruction current $I_{op}$ (solid line) to the lower coil 34 and the exciting current I (broken line) through the lower coil 34.

If the valve 12 is properly held at the open valve end, that is, if the armature 22 is in close contact with the lower electromagnet 26, a great magnetic flux Φ occurs through the lower electromagnet 26 during the holding period. In this case, the lower electromagnet 26 produces a great reverse electromotive force after the instruction current $I_{op}$ to the lower coil 34 is set to the reverse current $I_N$. Therefore, if the valve 12 is properly held at the open valve end before the valve closing request, the exciting current I flowing through the lower coil 34 after the setting of the instruction current $I_{op}$ to the lower coil 34 to the reverse current $I_N$ exhibits a gently decreasing tendency, as indicated in FIG. 22B.

The period during which the instruction current $I_{op}$ is maintained at the reverse current $I_N$ is set to such a period that when the exciting current I exhibits the aforementioned decreasing tendency, the exciting current I becomes a small current in the negative or reverse direction. Therefore, if the valve 12 is properly held at the open valve end before the valve closing request is outputted, the instruction current $I_{op}$ is switched from the reverse current $I_N$ to "0" at the time the exciting current I through the lower coil 34 becomes a small current in the negative or reverse direction.

The drive circuit 200 shown in FIG. 16 drives the first to fourth transistors 202–208 so that the exciting current I becomes equal to the instruction current $I_{op}$. Therefore, after the instruction current $I_{op}$ is switched from the reverse current $I_N$ to "0", the first and fourth transistors 202, 208 for applying forward voltage to the lower coil 34 are set in the on-state while $I<I_{op}=0$ holds, that is, until the negative exciting current discontinues.

If the valve 12 is properly held at the open valve end before the valve closing request, the negative exciting current quickly discontinues after the instruction current $I_{op}$ switched from the reverse current $I_N$ to "0". Under this condition , the period during which the first and fourth transistors 202, 208 are driven after the switching of the instruction current $I_{op}$ becomes very short as indicated in FIG. 22A.

Conversely, if the valve 12 steps out during the holding period, during which the valve 12 needs to be held at the open valve end, that is, if the lower electromagnet 26 and the armature 22 are not in close contact during the period, the magnetic flux Φ produced by the lower electromagnet 26 becomes a small value during the holding period. Therefore, the lower electromagnet 26 produces a small reverse electromotive force after the instruction current $I_{op}$ to the lower core 32 is switched to the reverse current $I_N$. Consequently, after the switching of the instruction current $I_{op}$, the exciting current I flowing through the lower coil 34 exhibits a sharply decreasing tendency as indicated in FIG. 23B.

If the exciting current I exhibits a sharply decreasing tendency as mentioned above after the switching of the instruction current $I_{op}$ to the reverse current $I_N$, the exciting current I becomes a great current in the negative or reverse direction before the instruction current $I_{op}$ is switched from the reverse current $I_N$ to "0", as indicated in FIG. 23B. Therefore, after the switching of the instruction current $I_{op}$ from the reverse current $I_N$ to "0", the first and fourth transistors 202, 208 are driven for a long time as indicated in FIG. 23A.

In the system of this embodiment, the length of the period for driving the first and fourth transistors 202, 208 after the switching of the instruction current $I_{op}$ from the reverse current $I_N$ to "0" greatly varies depending on whether the valve 12 is properly held at the open valve end before the output of the valve closing request. During the operation after the valve opening request, the variation in the length of the transistor driving period also occurs in the comparable circuit for the upper coil 30. Therefore, the system of this embodiment can precisely determine whether the valve 12 stepped out before the valve opening or closing request, on the basis of the operating state of the first and fourth transistors 202, 208 for the upper coil 30 and the lower coil 34.

The method described above precisely determines whether the valve 12 stepped out, after the magnetic flux Φ has converged to a sufficiently small value following the period during which the step out is likely to occur. Therefore, the method makes it possible to precisely determine whether the valve 12 has returned to a normal state, during the valve opening or closing cycle following the output of the return current $I_R$ in response to the step out of the valve 12.

Figure 24:
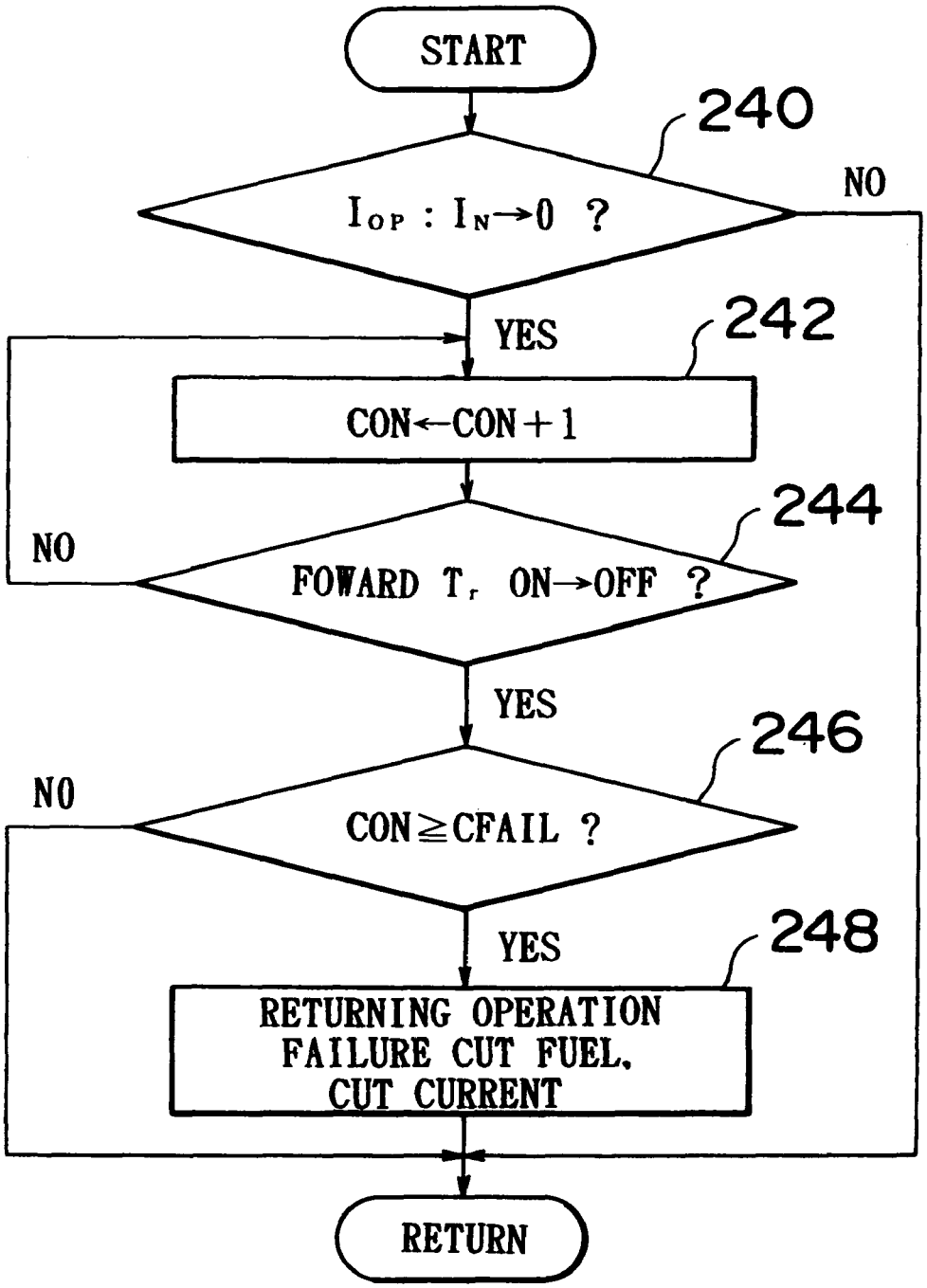
FIG. 24 is a flowchart illustrating a control routine executed to detect the step out of the valve in the electromagnetically driven valve of the sixth embodiment.

FIG. 24 shows a flowchart of a control routine executed by the controller 44 to accomplish the aforementioned function. The control routine realizes a hold state determining device. The controller 44 executes this routine for each of the upper coil 30 and the lower coil 34. This routine is a periodic interrupt routine executed every time one cycle of the routine ends. When the routine is started, the processing of step 240 is first executed.

In step 240, the controller 44 determines whether the instruction current $I_{op}$ to the coil of the control object (either the upper coil 30 or the lower coil 34) is switched from the reverse current $I_N$ to "0". If it is determined that the switching has not been performed, the present cycle of the routine immediately ends without further processing. Conversely, if it is determined in step 240 that the switching of the instruction current $I_{op}$ has been performed, operation proceeds to step 242.

In step 242, an operation counter CON is incremented. The operation counter CON is a counter for counting the period during which the forward transistors, that is, the first and fourth transistors 202, 208, are set in the on-state.

Subsequently in step 244, it is determined whether the aforementioned forward transistors have been switched from the on-state to the off-state. If it is determined that the switching of the state has not occurred, operation goes back to step 242. Conversely, if it is determined in step 244 that the state switching of the transistors has occurred, operation proceeds to step 246.

In step 246, it is determined whether the count of the operation counter CON is equal to or greater than a predetermined threshold CFAIL. If it is determined that CON≧CFAIL does not hold, it can be considered that the valve 12 is operating normally. In this case, the present cycle of the routine ends without further processing. Conversely, if it is determined in step 246 that CON≧CFAIL holds, it can be considered that the valve 12 has stepped out. In this case, operation proceeds to step 248.

In step 248, the controller 44 confirms that the returning operation based on the return current $I_R$ has failed, and performs operations for coping with the step out of the valve 12, that is, an operation of cutting fuel to the internal combustion engine, an operation of cutting the current to the electromagnetically driven valve 10, and the like. After step 248, the present cycle of the routine ends.

Through the operation described above, it becomes possible to immediately detect a step out where the returning to the normal state has failed despite the returning operation, and to stop the operation of the internal combustion engine when such a step out is detected, without a need to provide a sensor or the like for directly monitoring the operating state of the valve 12. Therefore, the system of this embodiment can realize, at a low cost, the function of avoiding an event that the internal combustion engine continues operating while the valve 12 is in the step out.

Although the foregoing embodiment determines whether the valve 12 has stepped out, in accordance with the length of the period during which the forward transistors are set in the on-state, this method does not restrict the method for detecting the step out of the valve 12 according to the present invention. In the foregoing embodiment, the operation time (on-time) varies depending on whether the valve 12 has stepped out because the change tendency of the exciting current I that occurs after the switching of the instruction current $I_{op}$ from the holding current $I_H$ to the reverse current $I_N$ varies depending on whether the valve 12 has stepped out.

Therefore, it is also possible to determine whether the valve 12 has stepped out, on the basis of the changing rate of the exciting current I occurring after the switching of the instruction current $I_{op}$ from the holding current $I_H$ to the reverse current $I_N$, the value of the exciting current I that occurs at the time of the switching of the instruction current $I_{op}$ from the reverse current $I_N$ to "0", and the like.

While the present invention has been described with reference to what are presently considered to be preferred embodiments thereof, it is to be understood that the invention is not limited to the disclosed embodiments or constructions. To the contrary, the invention is intended to cover various modifications and equivalent arrangements.

What is claimed is:

1. An apparatus for opening and closing a valve of an internal combustion engine, wherein the apparatus combines an electromagnetic force produced by an electromagnet and an elastic force produced by an elastic member to drive the valve, the apparatus comprising:

an attracting current supplier that supplies an attracting current to the electromagnet to attract the valve to the electromagnet;

a step-out detector that detects a step out of the valve from a predetermined opening and closing operation;

attracting current increase means for, when a step out is detected, increasing the attracting current to be used in a subsequent valve attracting cycle; and attracting current decrease means for, when a step out is not detected, decreasing the attracting current to be used in the subsequent cycle.

2. An apparatus according to claim 1, further comprising a return current supplier that, after a step out is detected, supplies to the electromagnet a return current that is greater than the attracting current.

3. An apparatus according to claim 1, further comprising:

a forward switch circuit that applies a voltage to the electromagnet in a forward direction;

a reverse switch circuit that applies a voltage to the electromagnet in a reverse direction; and a switch circuit controller that selectively operates the forward switch circuit and the reverse switch circuit so that an exciting current flowing through the electromagnet becomes substantially equal to a predetermined instruction current, wherein the step-out detector detects a step out when a voltage between two terminals of the electromagnet is smaller than a predetermined threshold voltage at a timing at which the exciting current is to be one of maintained and increased.

4. An apparatus according to claim 1, further comprising:

a forward switch circuit that applies a voltage to the electromagnet in a forward direction;

a reverse switch circuit that applies a voltage to the electromagnet in a reverse direction; and a switch circuit controller that selectively operates the forward switch circuit and the reverse switch circuit so that an exciting current flowing through the electromagnet becomes substantially equal to a predetermined instruction current, wherein the step-out detector detects a step out when the reverse switch circuit is operated at a timing at which the exciting current is to be one of maintained and increased.

5. An apparatus according to claim 1, wherein the step-out detector detects a step out when a density of a magnetic flux produced by the electromagnet is less than a predetermined value at a timing at which the valve is to be held adjacent to the electromagnet.

6. An apparatus according to claim 1, further comprising:

a reverse switch circuit that applies a voltage to the electromagnet in a reverse direction;

demagnetizing voltage applying means for operating the reverse switch circuit for a predetermined length of time at a timing at which the valve is to be separated from the electromagnet; and hold state determining means for determining whether the valve was held adjacent to the electromagnet on the basis of a state of an exciting current flowing through the electromagnet after operation of the reverse switch circuit.

7. A method of controlling opening and closing of a valve of an internal combustion engine by combining an electromagnetic force produced by an electromagnet and an elastic force produced by an elastic member, the control method comprising:

supplying an attracting current to the electromagnet when the valve is to be attracted to the electromagnet;

detecting whether there is a step out of the valve from a predetermined opening and closing operation;

increasing the attracting current to be used in a subsequent opening/closing cycle of the valve when a step out is detected; and decreasing the attracting current to be applied in the subsequent opening/closing cycle when a step out is not detected.

8. A method according to claim 7, further comprising, after a step out is detected, the step of supplying to the electromagnet a return current that is greater than the attracting current.

9. A method according to claim 7, further comprising the step of selectively applying one of a forward voltage and a reverse voltage to the electromagnet so that an exciting current flowing through the electromagnet becomes substantially equal to a predetermined instruction current, wherein in the step-out detecting step, a step out is detected when a voltage between two terminals of the electromagnet is smaller than a predetermined threshold voltage at a timing at which the exciting current is to be one of maintained and increased.

10. A method according to claim 7, further comprising the step of selectively applying a forward voltage and a reverse voltage to the electromagnet so that an exciting current flowing through the electromagnet becomes substantially equal to a predetermined instruction current, wherein in the step-out detecting step, a step out is detected when the reverse voltage is applied to the electromagnet at a timing at which the exciting current is to be one of maintained and increased.

11. A method according to claim 7, wherein in the step-out detecting step, a step out is detected when a density of a magnetic flux produced by the electromagnet is less than a predetermined value at a timing at which the valve is to be held adjacent to the electromagnet.

12. A method according to claim 7, further comprising the steps of:

applying a reverse voltage to the electromagnet for a predetermined length of time at a timing at which the valve is to be separated from the electromagnet; and determining whether the valve was held adjacent to the electromagnet on the basis of a state of an exciting current flowing through the electromagnet after application of the reverse voltage to the electromagnet.

* * * * *

UNITED STATES PATENT AND TRADEMARK OFFICE

CERTIFICATE OF CORRECTION

PATENT NO. : 6,044,814
DATED : April 4, 2000
INVENTOR(S) : Toshio Fuwa

It is certified that error appears in the above-identified patent and that said Letters Patent is hereby corrected as shown below:

Column 3,
Line 10, change "reverses" to -- reverse --.

Column 5,
Line 53, change "an" to -- a --.

Column 12,
Line 36, before "updated" insert -- is --.

Column 15,
Line 51, change "NE ≥NEO" to -- $NE \geq NE_0$ --.

Column 17,
Line 47, change "is" (second occurrence) to -- being --.

Column 18,
Line 38, insert after line 38, $\Phi = \int \left( \frac{V - I \bullet R}{N} \right) dt$ Column 19,
Line 31, change "101" to --Φ--.

Column 20,
Line 64, change ">" to -- ≥ --.

Column 23,
Line 40, change "di s continue" to -- discontinue --.

Column 24,
Line 31, before "switched" insert -- is --.

Column 26,
Line 61, change "one of" to -- either --.
Line 62, change "and" to -- or --.

UNITED STATES PATENT AND TRADEMARK OFFICE

CERTIFICATE OF CORRECTION

PATENT NO. : 6,044,814
DATED : April 4, 2000
INVENTOR(S) : Toshio Fuwa

It is certified that error appears in the above-identified patent and that said Letters Patent is hereby corrected as shown below:

Column 27,
Line 8, change "one of" to -- either --; change "and" to -- or --.

Column 28,
Line 15, change "one of" to -- either --; change "and" to -- or --.
Line 25, change "one of" to -- either --; change "and" to -- or --.

Signed and Sealed this

Twenty-fifth Day of December, 2001

*Attest:*

*Attesting Officer*

JAMES E. ROGAN
*Director of the United States Patent and Trademark Office*